US010662873B2

(12) United States Patent
Yoshimura

(10) Patent No.: US 10,662,873 B2
(45) Date of Patent: May 26, 2020

(54) CYLINDER BORE WALL HEAT INSULATION DEVICE, INTERNAL COMBUSTION ENGINE, AND AUTOMOBILE

(71) Applicant: NICHIAS CORPORATION, Tokyo (JP)

(72) Inventor: Akihiro Yoshimura, Hamamatsu (JP)

(73) Assignee: NICHIAS CORPORATION, Tokyo (JP)

( * ) Notice: Subject to any disclaimer, the term of this patent is extended or adjusted under 35 U.S.C. 154(b) by 0 days.

(21) Appl. No.: 15/773,281

(22) PCT Filed: Nov. 4, 2016

(86) PCT No.: PCT/JP2016/082726

§ 371 (c)(1),
(2) Date: May 3, 2018

(87) PCT Pub. No.: WO2017/078117

PCT Pub. Date: May 11, 2017

(65) Prior Publication Data

US 2018/0328277 A1 Nov. 15, 2018

(30) Foreign Application Priority Data

Nov. 5, 2015 (JP) ..... 2015-217809

(51) Int. Cl.
*F02B 77/11* (2006.01)
*F01P 3/02* (2006.01)
(Continued)

(52) U.S. Cl.
CPC ..... *F02B 77/11* (2013.01); *F01P 3/02* (2013.01); *F02F 1/10* (2013.01); *F02F 1/14* (2013.01); *F02F 1/18* (2013.01)

(58) Field of Classification Search
CPC ..... F02F 1/10; F02F 1/14; F01P 3/02; F01P 2003/021
(Continued)

(56) References Cited

U.S. PATENT DOCUMENTS 4,569,313 A * 2/1986 Nobu ..... F01P 3/02 123/41.74
4,616,600 A * 10/1986 Hirano ..... F01P 3/22 123/41.21
(Continued)

FOREIGN PATENT DOCUMENTS

JP 9-208752 A 8/1997
JP 2004-143262 A 5/2004
(Continued)

OTHER PUBLICATIONS

International Search Report dated Dec. 27, 2016, issued in counterpart International Application No. PCT/JP2016/082726 (2 pages).
(Continued)

*Primary Examiner* — John M Zaleskas
(74) *Attorney, Agent, or Firm* — Westerman, Hattori, Daniels & Adrian, LLP

(57) ABSTRACT

A cylinder bore wall thermal insulator includes one or more rubber sections in contact with a wall surface on the cylinder bore side of a groove-like cooling water channel, a base section having a shape conforming to a shape of a one-side half of the groove-like cooling water channel, the one or more rubber sections or one or more members to which the one or more rubber sections are fixed being fixed to the base section, and one or more elastic members for urging the entire one or more rubber sections to be pressed from a rear surface side toward the wall surface on the cylinder bore side of the groove-like cooling water channel. The thermal insulator includes a vertical wall near a boundary of each
(Continued)

bore section of the base section and on a near side of the boundary of each bore section of the base section.

12 Claims, 16 Drawing Sheets

(51) Int. Cl.
*F02F 1/10* (2006.01)
*F02F 1/18* (2006.01)
*F02F 1/14* (2006.01)

(58) Field of Classification Search
USPC ..... 123/41.72, 41.74, 41.79
See application file for complete search history.

(56) References Cited

U.S. PATENT DOCUMENTS

| | | | | | |
|---|---|---|---|---|---|
| 5,558,048 | A * | 9/1996 | Suzuki | F02B 75/20 | 123/41.74 |
| 2005/0217614 | A1* | 10/2005 | Matsutani | F02F 1/108 | 123/41.74 |
| 2005/0235930 | A1* | 10/2005 | Xin | F02F 1/108 | 123/41.74 |
| 2008/0060593 | A1* | 3/2008 | Nakada | F01P 3/02 | 123/41.79 |
| 2009/0194046 | A1* | 8/2009 | Shikida | F02F 1/14 | 123/41.74 |
| 2009/0266315 | A1* | 10/2009 | Hanai | F02F 1/14 | 123/41.72 |
| 2010/0031902 | A1* | 2/2010 | Alyanak | F02F 1/14 | 123/41.44 |
| 2010/0242868 | A1* | 9/2010 | Shikida | F01P 3/02 | 123/41.79 |
| 2011/0114040 | A1* | 5/2011 | Hashimoto | F02F 1/14 | 123/41.72 |
| 2011/0114041 | A1* | 5/2011 | Hamakawa | F02F 1/14 | 123/41.72 |
| 2011/0114042 | A1* | 5/2011 | Hamakawa | F02F 1/14 | 123/41.72 |
| 2011/0114043 | A1* | 5/2011 | Hamakawa | F02F 1/14 | 123/41.74 |
| 2011/0132295 | A1* | 6/2011 | Hamakawa | F02F 1/14 | 123/41.74 |
| 2011/0214630 | A1* | 9/2011 | Weed | F02B 75/18 | 123/41.74 |
| 2012/0132157 | A1* | 5/2012 | Matsuki | F02F 1/14 | 123/41.79 |
| 2012/0204821 | A1* | 8/2012 | Tofukuji | F02F 1/14 | 123/41.79 |
| 2013/0160725 | A1* | 6/2013 | Nishio | F02F 1/10 | 123/41.79 |
| 2015/0075454 | A1* | 3/2015 | Hamakawa | F02F 1/14 | 123/41.28 |
| 2015/0240743 | A1* | 8/2015 | Nishio | F02F 1/10 | 123/41.79 |
| 2015/0285125 | A1* | 10/2015 | Hayman | F02F 1/14 | 123/41.72 |
| 2016/0017838 | A1* | 1/2016 | Nishio | F02F 1/14 | 123/193.2 |
| 2016/0195000 | A1* | 7/2016 | Nakashima | F01P 3/02 | 123/41.74 |
| 2017/0022929 | A1* | 1/2017 | Karita | F02F 1/14 | |
| 2017/0030289 | A1* | 2/2017 | Okawa | F02F 1/14 | |
| 2017/0045012 | A1* | 2/2017 | Okawa | F01P 3/02 | |
| 2018/0355780 | A1* | 12/2018 | Fujita | F02F 1/14 | |
| 2018/0363587 | A1* | 12/2018 | Yoshimura | F02F 1/14 | |
| 2019/0032595 | A1* | 1/2019 | Yoshimura | F02F 1/14 | |

FOREIGN PATENT DOCUMENTS

| | | | | | |
|---|---|---|---|---|---|
| JP | 2005-120944 | A | | 5/2005 | |
| JP | 2005-315118 | A | | 11/2005 | |
| JP | 2005315118 | A | * | 11/2005 | |
| JP | 2007-247590 | A | | 9/2007 | |
| JP | 2008-31939 | A | | 2/2008 | |
| JP | 2008128133 | A | * | 6/2008 | F02F 1/14 |
| JP | 2008-208744 | A | | 9/2008 | |
| JP | 2012007478 | A | * | 1/2012 | F02F 1/14 |
| JP | 2013-217343 | A | | 10/2013 | |
| JP | 2014-92031 | A | | 5/2014 | |
| JP | 2014194219 | A | * | 10/2014 | |
| WO | 2015/156207 | A1 | | 10/2015 | |
| WO | WO-2015156207 | A1 | * | 10/2015 | F02F 1/14 |
| WO | WO-2015156208 | A1 | * | 10/2015 | F01P 3/02 |

OTHER PUBLICATIONS

Extended (supplementary) European Search Report dated May 17, 2019, issued in counterpart EP Application No. 16862177.9. (7 pages).

* cited by examiner

CYLINDER BORE WALL HEAT INSULATION DEVICE, INTERNAL COMBUSTION ENGINE, AND AUTOMOBILE

TECHNICAL FIELD

The present invention relates to a thermal insulator disposed in contact with a wall surface on a groove-like cooling water channel of a cylinder bore wall of a cylinder block of an internal combustion engine, an internal combustion engine including the thermal insulator, and an automobile including the internal combustion engine.

BACKGROUND ART

In an internal combustion engine, the structure of which is such that an explosion of fuel occurs at a top dead point of a piston in a bore and the piston is pushed down by the explosion, temperature rises on an upper side of a cylinder bore wall and temperature falls on a lower side of the cylinder bore wall. Therefore, a difference occurs in a thermal deformation amount between the upper side and the lower side of the cylinder bore wall. Expansion is large on the upper side and, on the other hand, expansion is small on the lower side.

As a result, frictional resistance between the piston and the cylinder bore wall increases. This causes a decrease in fuel efficiency. Therefore, there is a need to reduce the difference in the thermal deformation amount between the upper side and the lower side of the cylinder bore wall.

Therefore, conventionally, in order to uniformize a wall temperature of the cylinder bore wall, it has been attempted to set a spacer in the groove-like cooling water channel for adjusting a water flow of cooling water in the groove-like cooling water channel and controlling cooling efficiency on the upper side and cooling efficiency on the lower side of the cylinder bore wall by the cooling water. For example, Patent Literature 1 discloses a heat medium channel partitioning member for internal combustion engine cooling including: a channel partitioning member disposed in a groove-like heat medium channel for cooling formed in a cylinder block of an internal combustion engine to partition the groove-like heat medium channel for cooling into a plurality of channels, the channel partitioning member being formed at height smaller than the depth of the groove-like heat medium channel for cooling and functioning as a wall section that divides the groove-like heat medium channel for cooling into a bore side channel and a counter-bore side channel; and a flexible rip member formed from the channel partitioning member toward an opening section direction of the groove-like heat medium channel for cooling and formed of a flexible material in a form with a distal end edge portion passing over one inner surface of the groove-like heat medium channel for cooling, whereby, after completion of insertion into the groove-like heat medium channel for cooling, the distal end edge portion comes into contact with the inner wall in an intermediate position in a depth direction of the groove-like heat medium channel for cooling with a deflection restoration force of the distal end edge portion to separate the bore side channel and the counter-bore side channel.

CITATION LIST

Patent Literature

[Patent Literature 1]
Japanese Patent Laid-Open No. 2008-31939 (Claims)

SUMMARY OF INVENTION

Technical Problem

With the heat medium channel partitioning member for internal combustion engine cooling of Cited Literature 1, a certain degree of uniformization of the wall temperature of the cylinder bore wall can be achieved. Therefore, it is possible to reduce the difference in the thermal deformation amount between the upper side and the lower side of the cylinder bore wall. However, in recent years, there is a need to further reduce the difference in the thermal deformation amount between the upper side and the lower side of the cylinder bore wall.

Therefore, an object of the present invention is to provide an internal combustion engine with high uniformity of a wall temperature of a cylinder bore wall.

Solution to Problem

The object is attained by the present invention explained below. Specifically, the present invention (1) is a cylinder bore wall thermal insulator set in a groove-like cooling water channel of a cylinder block of an internal combustion engine including cylinder bores to insulate a bore wall in a one-side half of bore walls of all the cylinder bores, the thermal insulator including: one or more rubber sections in contact with a wall surface on the cylinder bore side of the groove-like cooling water channel to cover the wall surface on the cylinder bore side of the groove-like cooling water channel; a base section having a shape conforming to a shape of the one-side half of the groove-like cooling water channel, the one or more rubber sections or one or more members to which the one or more rubber sections are fixed being fixed to the base section; and one or more elastic members for urging the entire one or more rubber sections to be pressed from a rear surface side toward the wall surface on the cylinder bore side in a middle and lower part of the groove-like cooling water channel, wherein the thermal insulator includes a vertical wall on a near side of a boundary of each bore section of the base section in a flowing direction of cooling water.

The present invention (2) provides the cylinder bore wall thermal insulator according to (1), wherein the base section and the vertical wall are made of a metal plate.

The present invention (3) provides the cylinder bore wall thermal insulator according to (1) or (2), wherein the rubber section is heat-sensitive expanding rubber or water-swelling rubber.

The present invention (4) provides an internal combustion engine, in a cylinder block of which a groove-like cooling water channel is formed, wherein the cylinder bore wall thermal insulator according to any one of (1) to (3) is set in a groove-like cooling water channel in a one-side half in the groove-like cooling water channel.

The present invention (5) provides an internal combustion engine, a cylinder block of which a groove-like cooling water channel is formed, wherein the groove-like cooling water channel is partitioned such that the cooling water flowing in the groove-like cooling water channel flows to a groove-like cooling water channel in one one-side half first and, thereafter, flows in a groove-like cooling water channel in another one-side half, and the cylinder bore wall thermal insulator according to any one of (1) to (3) is set in the groove-like cooling water channel in the other one-side half.

The present invention (6) provides an automobile including the internal combustion engine according to (4) or (5).

Advantageous Effects of Invention

According to the present invention, it is possible to improve uniformity of a wall temperature of a cylinder bore wall of an internal combustion engine. Therefore, according to the present invention, it is possible to reduce a difference in a thermal deformation amount on an upper side and a lower side of the cylinder bore wall.

DESCRIPTION OF EMBODIMENTS

Figure 1:
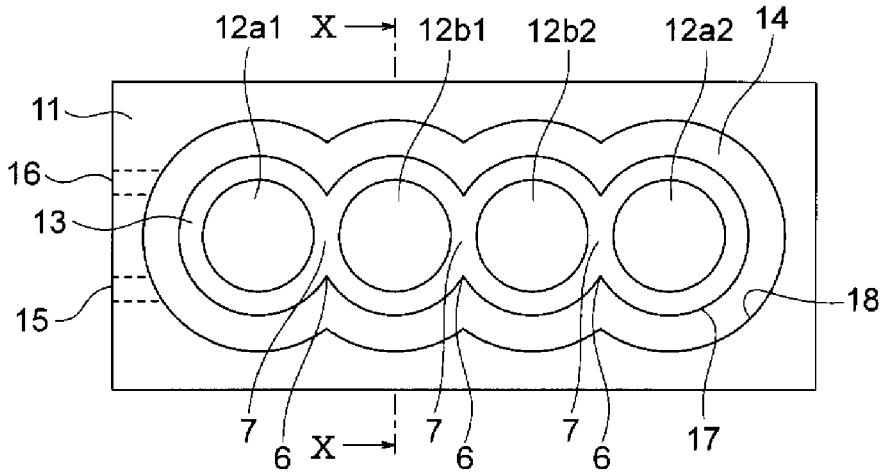
FIG. 1 is a schematic plan view showing a form example of a cylinder block in which a cylinder bore wall thermal insulator of the present invention is set.
Figure 2:
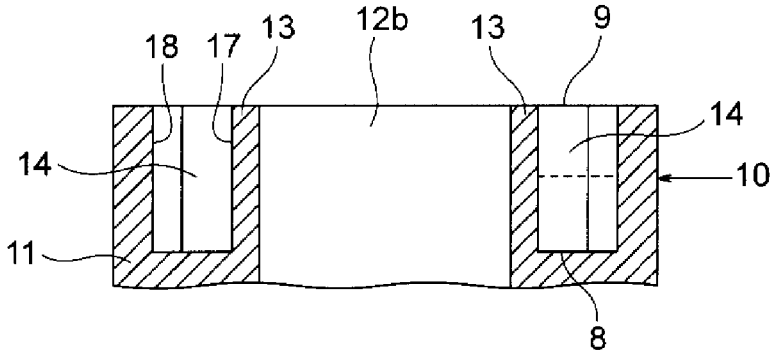
FIG. 2 is an x-x line sectional view of FIG. 1.
Figure 3:
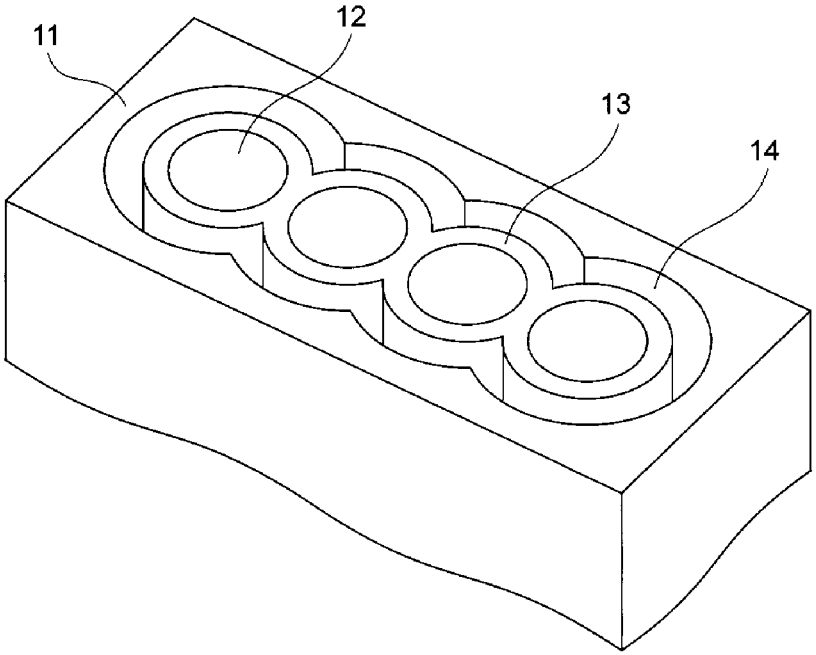
FIG. 3 is a perspective view of the cylinder block shown in FIG. 1.
Figure 4:
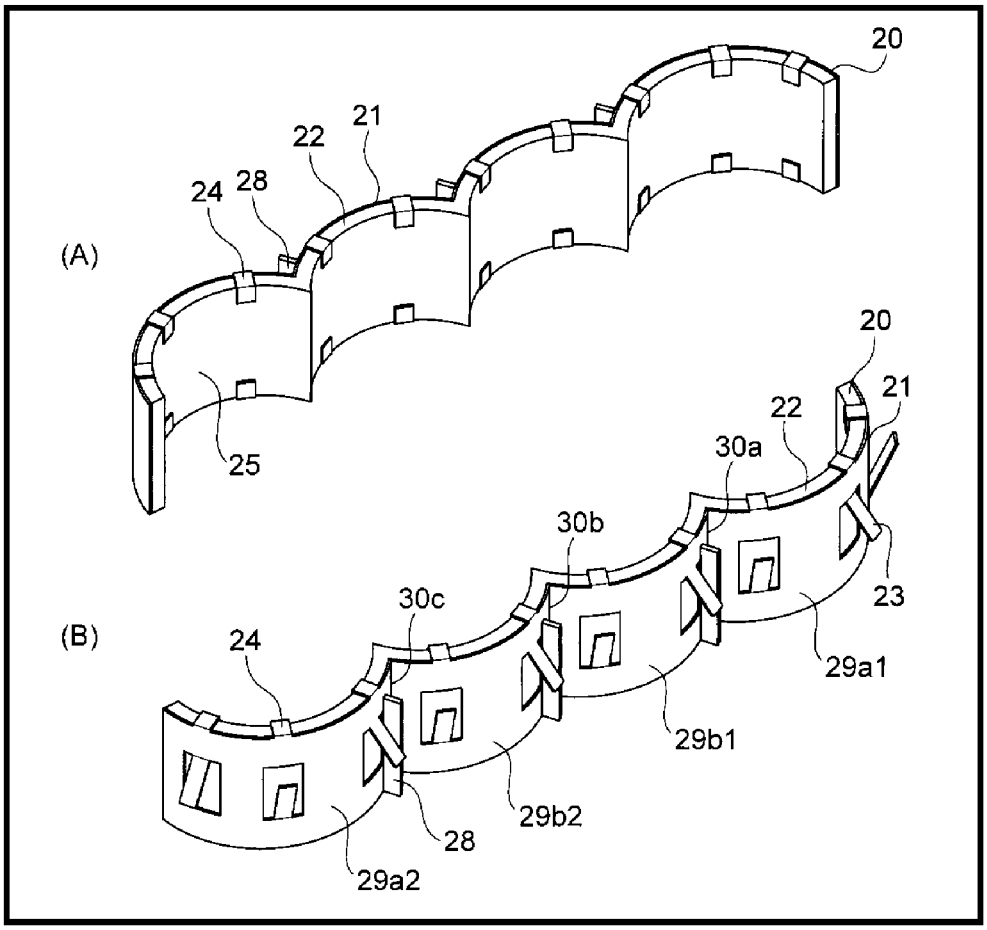
FIG. 4 is a schematic perspective view showing a form example of the cylinder bore wall thermal insulator of the present invention.
Figure 5:
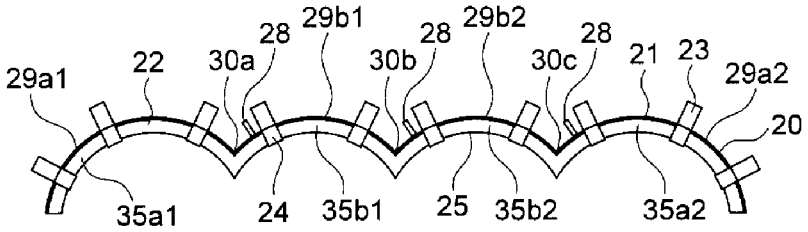
FIG. 5 is a plan view of the cylinder bore wall thermal insulator shown in FIG. 4 viewed from an upper side.
Figure 6:
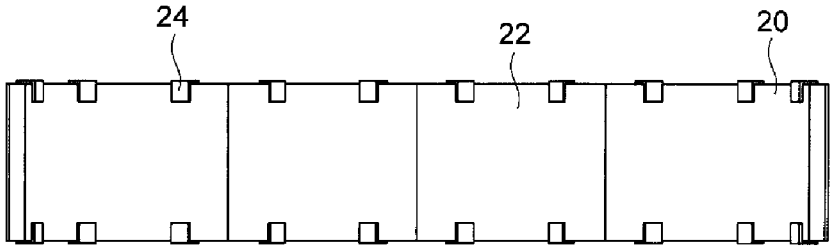
FIG. 6 is a view of the cylinder bore wall thermal insulator shown in FIG. 4 viewed from a rubber member side.
Figure 7:
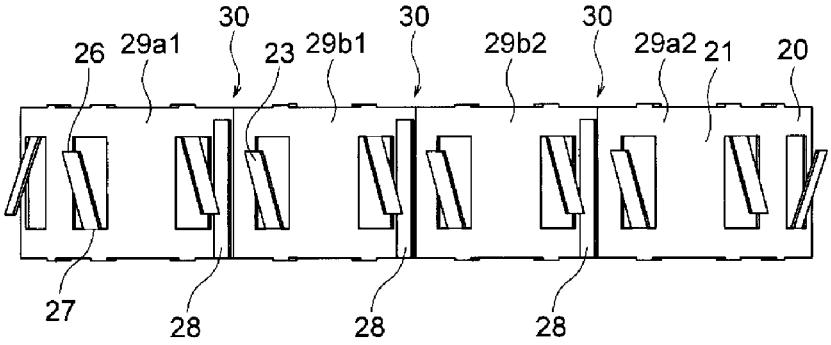
FIG. 7 is a view of the cylinder bore wall thermal insulator shown in FIG. 4 viewed from a rear surface side.

A cylinder bore wall thermal insulator of the present invention and an internal combustion engine of the present invention are explained with reference to FIG. 1 to FIG. 7. FIG. 1 to FIG. 3 show a form example of a cylinder block in which the cylinder bore wall thermal insulator of the present invention is set. FIG. 1 is a schematic plan view showing the cylinder block in which the cylinder bore wall thermal insulator of the present invention is set. FIG. 2 is an x-x line sectional view of FIG. 1. FIG. 3 is a perspective view of the cylinder block shown in FIG. 1. FIG. 4 is a schematic perspective view showing a form example of the cylinder bore wall thermal insulator of the present invention. FIG. 5 is a view of a cylinder bore wall thermal insulator 20 shown in FIG. 4 viewed from above. FIG. 6 is a view of the cylinder bore wall thermal insulator 20 shown in FIG. 4 viewed from a side and is a view of the cylinder bore wall thermal insulator 20 viewed from a contact surface side of a rubber section 22. FIG. 7 is a view of the cylinder bore wall thermal insulator 20 shown in FIG. 4 viewed from a side and a view of the cylinder bore wall thermal insulator 20 viewed from a rear surface side.

As shown in FIG. 1 to FIG. 3, in a cylinder block 11 of an open deck type of an internal combustion engine for vehicle mounting in which the cylinder bore wall thermal insulator is set, a bore 12 for a piston to move up and down and a groove-like cooling water channel 14 for feeding cooling water are formed. A wall partitioning the bore 12 and the groove-like cooling water channel 14 is a cylinder bore wall 13. In the cylinder block 11, a cooling water supply port 15 for supplying the cooling water to the groove-like cooling water channel 11 and a cooling water discharge port 16 for discharging the cooling water from the groove-like cooling water channel 11 are formed.

In the cylinder block 11, two or more bores 12 are formed side by side in series. Therefore, as the bores 12, there are end bores 12*a*1 and 12*a*2 adjacent to one bore and intermediate bores 12*b*1 and 12*b*2 sandwiched by two bores (note that, when the number of bores of the cylinder block is two, there are only the end bores). Among bores formed side by side in series, the end bores 12*a*1 and 12*a*2 are bores at both ends. The intermediate bores 12*b*1 and 12*b*2 are bores present between the end bore 12*a*1 at one end and the end bore 12*a*2 at the other end. A wall between the end bore 12*a*1 and the intermediate bore 12*bl*, a wall between the intermediate bore 12*b*1 and the intermediate bore 12*b*2, and a wall between the intermediate bore 12*b*2 and the end bore 12*a*2 (inter-bore walls 7) are portion sandwiched by two bores. Therefore, since heat is transmitted from two cylinder bores, wall temperature is higher than other walls. Therefore, on a wall surface 17 on the cylinder bore side of the groove-like cooling water channel 14, temperature is the highest near the inter-bore walls 7. Therefore, the temperature of a boundary 6 of each bore section and the vicinity of the boundary 6 is the highest in the wall surface 17 on the cylinder bore side of the groove-like cooling water channel 14.

In the present invention, in a wall surface of the groove-like cooling water channel 14, a wall surface on the cylinder bore 13 side is described as wall surface 17 on the cylinder bore side of the groove-like cooling water channel. In the wall surface of the groove-like cooling water channel 14, a wall surface on the opposite side of the wall surface 17 on the cylinder bore side of the groove-like cooling water channel is described as wall surface 18.

The cylinder bore wall thermal insulator 20 shown in FIG. 4 to FIG. 7 includes a base section 21, a rubber section 22, and metal leaf springs 23. The thermal insulator 20 includes vertical walls 28 on a rear surface side of the base section 21.

When viewed from above, the rubber section 22 is molded into a shape of continuous four arcs. The shape on a contact surface 25 side of the rubber section 22 is a shape conforming to a wall surface on the cylinder bore side of the groove-like cooling water channel 14. The rubber section 22 is a member in direct contact with a wall surface on the cylinder bore side of the groove-like cooling water channel 14 to cover an insulating part of the wall surface on the cylinder bore side of the groove-like cooling water channel 14 and insulate the insulating part. Bending sections 24 formed on the upper side and the lower side of the base section 21 are bent. The rubber section 22 is sandwiched between the base section 21 and the bending sections 24 to thereby be fixed to the base section 21. In the rubber section 22, a surface of the rubber section 22 on the opposite side of the base section 21 side is the contact surface 25 in contact with the wall surface 17 on the cylinder bore side of the groove-like cooling water channel.

The base section 21 is made of a metal plate. When viewed from above, the base section 21 is molded into a shape of continuous four arcs. The shape of the base section 21 is a shape conforming to a rear surface side of the rubber section 22 (a surface on the opposite side of the contact surface 25 side).

The rubber section 22 of the cylinder bore wall thermal insulator 20 includes bore sections 35*a*1 of the rubber section in contact with a wall surface on the end bore 12*a*1 side at one end, bore sections 35*a*2 of the rubber section in contact with a wall surface on the end bore 12*a*2 side at the other end, and the bore sections 35*b*1 and 35*b*2 of the rubber section in contact with a wall surface on the intermediate bores 12*b*1 and 12*b*2 side in the wall surface on the bore side of the groove-like cooling water channel 14. The bore sections 35*a*1 of the rubber section are rubber section for insulating the wall surface on the end bore 12*a*1 side at one end. The bore sections 35*a*2 of the rubber section are rubber sections for insulating the wall surface on the end bore 12*a*2 side at the other end. The bore sections 35*b*1 and 35*b*2 of the rubber section are respectively rubber sections for insulating the wall surface on the intermediate bores 12*b*1 and 12*b*2 side.

The base section 21 of the cylinder bore wall thermal insulator 20 is formed of one metal plate from the end bore 12*a*1 side at one end to the end bore 12*a*2 side at the other end. Therefore, in the base section 21 of the cylinder bore wall thermal insulator 20, bore sections 29*a*1 of the base body section on the end bore 12*a*1 side at one end, bore sections 29*b*1 and 29*b*2 of the base section on the intermediate bores 12*b*1 and 12*b*2 side, and bore sections 29*a*2 of the base section on the end bore 12*a*2 side at the other end are connected. A boundary between the bore section 29*a*1 and 29*b*1 of the base section is a boundary 30*a* of each bore section of the base section. A boundary between the bore section 29*b*1 and 29*b*2 of the base section is a boundary 30*b* of each bore section of the base section. A boundary between the bore section 29*b*2 and 29*a*2 of the base section is a boundary 30*c* of each bore section of the base section.

The metal leaf spring 23 formed by being integrally molded with the base section 21 is attached to the base section 21. The material of the metal leaf spring 23 is metal. The metal leaf spring 23 is a tabular elastic body. The metal leaf spring 23 is attached to the base section 21 by being bent from the base section 21 on the other end side 27 connected to the base section 21 such that one end side 26 separates from the base section 21.

The cylinder bore wall thermal insulator 20 includes the vertical walls 28 on the rear surface side. Positions where the vertical walls 28 are set are on a near side of the boundary 30 of each bore section of the base section 21 in a flowing direction of the cooling water when the cylinder bore wall thermal insulator 20 is set in the groove-like cooling water channel of the cylinder block. As a setting range in the up-down direction of the vertical walls 28, a lower end is up to the lower end of the base section 21 and an upper end is up to slightly below the upper end of the base section 21.

Figure 8:
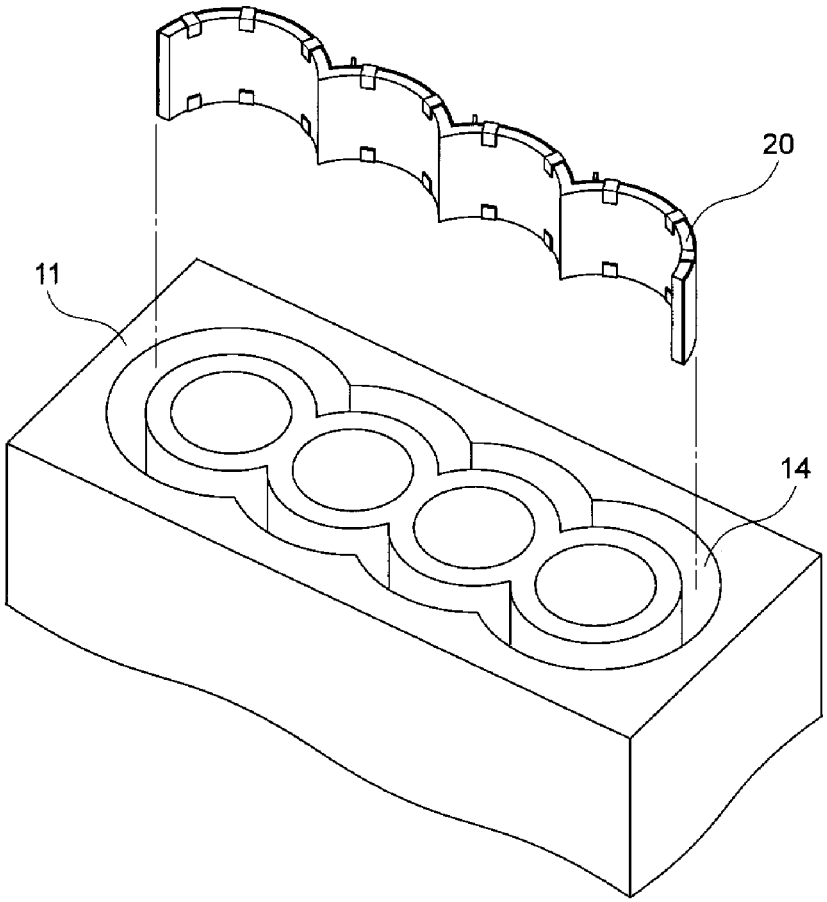
FIG. 8 is a schematic view showing a state in which a cylinder bore wall thermal insulator 20 is set in a cylinder block 11 shown in FIG. 1.
Figure 9:
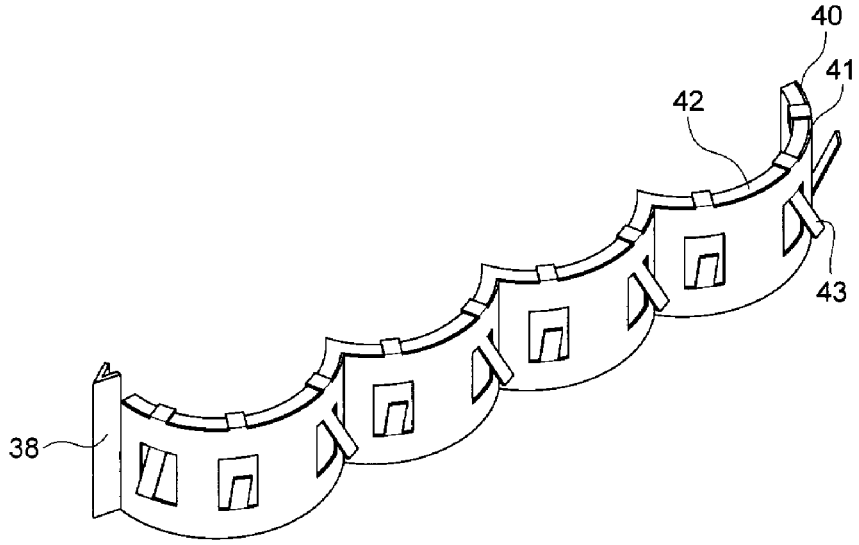
FIG. 9 is a perspective view showing a cylinder bore wall thermal insulator 40.
Figure 10:
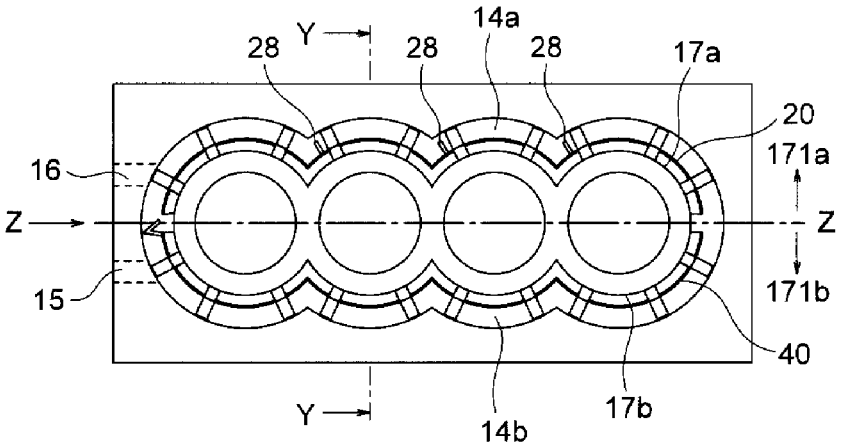
FIG. 10 is a schematic view showing a state in which cylinder bore wall thermal insulators 20 and 40 are set in the cylinder block 11 shown in FIG. 1.
Figure 11:
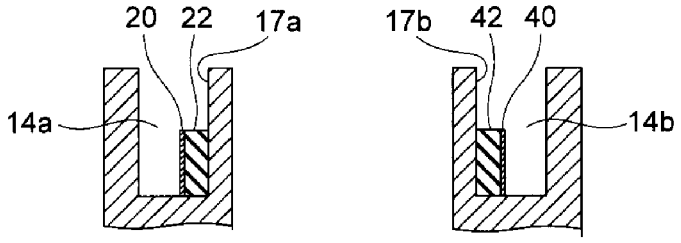
FIG. 11 is a Y-Y line end face view of FIG. 10.

Use forms of the cylinder bore wall thermal insulator 20 are explained with reference to FIG. 8 to FIG. 11. For example, as shown in FIG. 8, the cylinder bore wall thermal insulator 20 is inserted into the groove-like cooling water channel 14 of the cylinder block 11 shown in FIG. 1. As shown in FIG. 10 and FIG. 11, the cylinder bore wall thermal insulator 20 is set in a groove-like cooling water channel 14*a* in one one-side half in the entire groove-like cooling water channel. In FIG. 10 and FIG. 11, a thermal insulator set in a groove-like cooling water channel 14*b* in the other one-side half is a cylinder bore wall thermal insulator 40. The cylinder bore wall thermal insulator 40 is shown in FIG. 9. In FIG. 9, the cylinder bore wall thermal insulator 40 includes a rubber section 42 for covering a wall surface on the cylinder bore side of the groove-like cooling water channel of the cylinder block, a base section 41 to which the rubber section 42 is fixed, and metal leaf springs 43 for urging the base section 41 to press the rubber section 42 toward the wall surface on the cylinder bore side of the groove-like cooling water channel. The cylinder bore wall thermal insulator 40 includes a cooling-water-flow partitioning member 38 at one end portion of the base section 21. The cylinder bore wall thermal insulator 40 and the cylinder bore wall thermal insulator 20 are different in that, whereas the former includes the cooling-water-flow partitioning member 38 at one end portion, the latter does not include a cooling-water-flow partitioning member and in that, whereas the former does not include vertical walls on the rear surface side of the base section, the latter includes vertical walls on the rear surface side of the base section. However, both of the thermal insulators are the same in other points, that is, the base section, the rubber section, and the metal leaf springs.

Note that, in the present invention, the wall surface on the one-side half side in the entire wall surface on the cylinder bore side of the groove-like cooling water channel indicates a wall surface in a half on one side at the time when a wall surface on the cylinder bore side of the groove-like cooling water channel is vertically divided into two in the direction in which the cylinder bores are disposed side by side. For example, in FIG. 10, the direction in which the cylinder bores are disposed side by side is a Z-Z direction. Each of wall surfaces in one-side halves at the time when the wall surface is divided into two by this Z-Z line is a wall surface in a one-side half in the entire wall surface on the cylinder bore side of the groove-like cooling water channel. The groove-like cooling water channel in the one-side half indicates a groove-like cooling water channel in a half on one side at the time when the wall surface is vertically divided into two in the direction in which the cylinder bores are disposed side by side. For example, in FIG. 10, each of groove-like cooling water channels in the one-side halves at the time when the wall surface is vertically divided into two by the Z-Z line is a groove-like cooling water channel in a one-side half. In other words, in FIG. 10, a wall surface in a 171*a*-side half of the Z-Z line is a wall surface 17*a* in one one-side half in the entire wall surface 17 on the cylinder bore side of the groove-like cooling water channel. A wall surface in a 171*b*-side half is a wall surface 17*b* in the other one-side half in the entire wall surface 17 on the cylinder bore side of the groove-like cooling water channel. A groove-like cooling water channel in the 171*a*-side half of the Z-Z line is the groove-like cooling water channel 14*a* in one one-side half. A groove-like cooling water channel in the 171*b*-side half of the Z-Z line is the groove-like cooling water channel 14*b* in one one-side half.

At this time, in the cylinder bore wall thermal insulator 20, the metal leaf springs 23 are attached such that the distance from the contact surface 25 of the rubber section 22 to the one end side 26 of the metal leaf springs 23 is larger than the width of the groove-like cooling water channel 14. Therefore, when the cylinder bore wall thermal insulator 20 is set in the groove-like cooling water channel 14, the metal leaf springs 23 are sandwiched between the base section 21 and the rubber section 22 and the wall surface 18, whereby a force in a direction toward the base section 21 is applied to the one end side 26 of the metal leaf springs 23. Consequently, the metal leaf springs 23 are deformed such that the one end side 26 approaches the base section 21 side. Therefore, a restoring elastic force is generated in the metal leaf spring 23. The base section 21 is pushed by the elastic force toward the wall surface 17 on the cylinder bore side of the groove-like cooling water channel. As a result, the rubber section 22 is pressed against the wall surface 17 on the cylinder bore side of the groove-like cooling water channel by the base section 21. In other words, the cylinder bore wall thermal insulator 20 is set in the groove-like cooling water channel 14, whereby the metal leaf springs 23 are deformed. The base section 21 is urged by a restoring elastic force of the deformation to press the rubber section 22 against the wall surface 17 on the cylinder bore side of the groove-like cooling water channel. In this way, in the cylinder bore wall thermal insulator 20, the rubber section 22 comes into contact with the wall surface 17*a* in one one-side half in the entire wall surface 17 on the cylinder bore side of the groove-like cooling water channel. The same applies to the cylinder bore wall thermal insulator 40.

Figure 12:
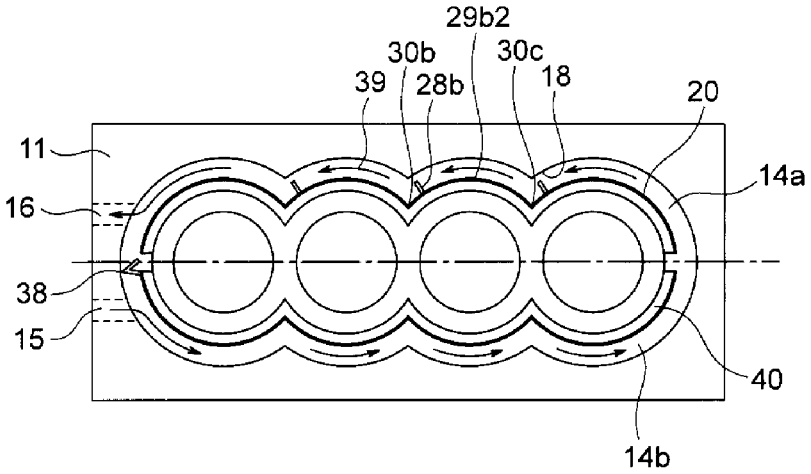
FIG. 12 is a view showing a state in which cooling water is fed into a groove-like cooling water channel in a form example shown in FIG. 10.

FIG. 12 is a view showing a state at the time when the cylinder bore wall thermal insulator 20 and the cylinder bore wall thermal insulator 40 are set in the groove-like cooling water channel 14 of the cylinder block 11 and the cooling water is fed into the groove-like cooling water channel 14. A flowing direction of the cooling water is indicated by an arrow of a reference numeral 39. First, the cooling water is supplied into the groove-like cooling water channel 14 from the cooling water supply port 15. The cooling-water-flow partitioning member 38 is set between the cooling water supply port 15 and the cooling water discharge port 16 of the groove-like cooling water channel 14. Therefore, as indicated by the arrow 39 in FIG. 12, the cooling water supplied from the cooling water supply port 15 flows toward an end on the opposite side of the position of the cooling water supply port 15 in the groove-like cooling water channel 14*b* in the other one-side half and, when reaching the end on the opposite side of the position of the cooling water supply port 15 of the groove-like cooling water channel 14*b* in the other one-side half, turns to the groove-like cooling water channel 14*a* in one one-side half, subsequently, flows toward the cooling water discharge port 16 in the groove-like cooling water channel 14*a* in one one-side half, and is finally discharged from the cooling water discharge port 16.

At this time, the cylinder bore wall thermal insulator 20 is set in the groove-like cooling water channel 14*a* in one one-side half. The vertical walls 28 are set on the rear surface side of the cylinder bore wall thermal insulator 20. When focusing on the bore sections 29*b*2 of the base section, the boundary 30*c* to the boundary 30*b* of each bore section of the base section are the bore sections 29*b*2 of the base section. The vertical walls 28*b* are set on the rear surface side of the bore sections 29*b*2 of the base section. In the groove-like cooling water channel 14*a* in one one-side half, the cooling water is flowing from the boundary 30*c* to the boundary 30*b*. Therefore, the vertical wall 28*b* is set on the near side of the boundary 30*b* of each bore section of the base section in the flowing direction of the cooling water. Most of the cooling water flowing on the rear surface side of the bore sections 29*b*2 of the base section hits the vertical wall 28*b* set before the boundary 30*b* of each core section of the base section.

Note that, in the form example shown in FIG. 10, the cylinder block of the form is described in which the cooling water flowing to the end in the groove-like cooling water channel 14*a* in one one-side half is discharged from the cooling water discharge port 16 formed on the lateral side of the cylinder block 11. Besides, for example, there is a cylinder block of a form in which, for example, the cooling water supplied from the cooling water supply port 15 flows toward the end on the opposite side of the position of the cooling water supply port 15 in the groove-like cooling water channel 14*b* in the other one-side half and, when reaching the end on the opposite side of the position of the cooling water supply port 15 of the groove-like cooling water channel 14*b* in the other one-side half, turns to the groove-like cooling water channel 14*a* in one one-side half, subsequently, flows from one end to the other end in the groove-like cooling water channel 14*a* in one one-side half, and the cooling water flowing from one end to the other end in the groove-like cooling water channel 14*a* in one one-side half flows into the cooling water channel formed in the cylinder head rather than being discharged from the lateral side of the cylinder block.

Figure 13:
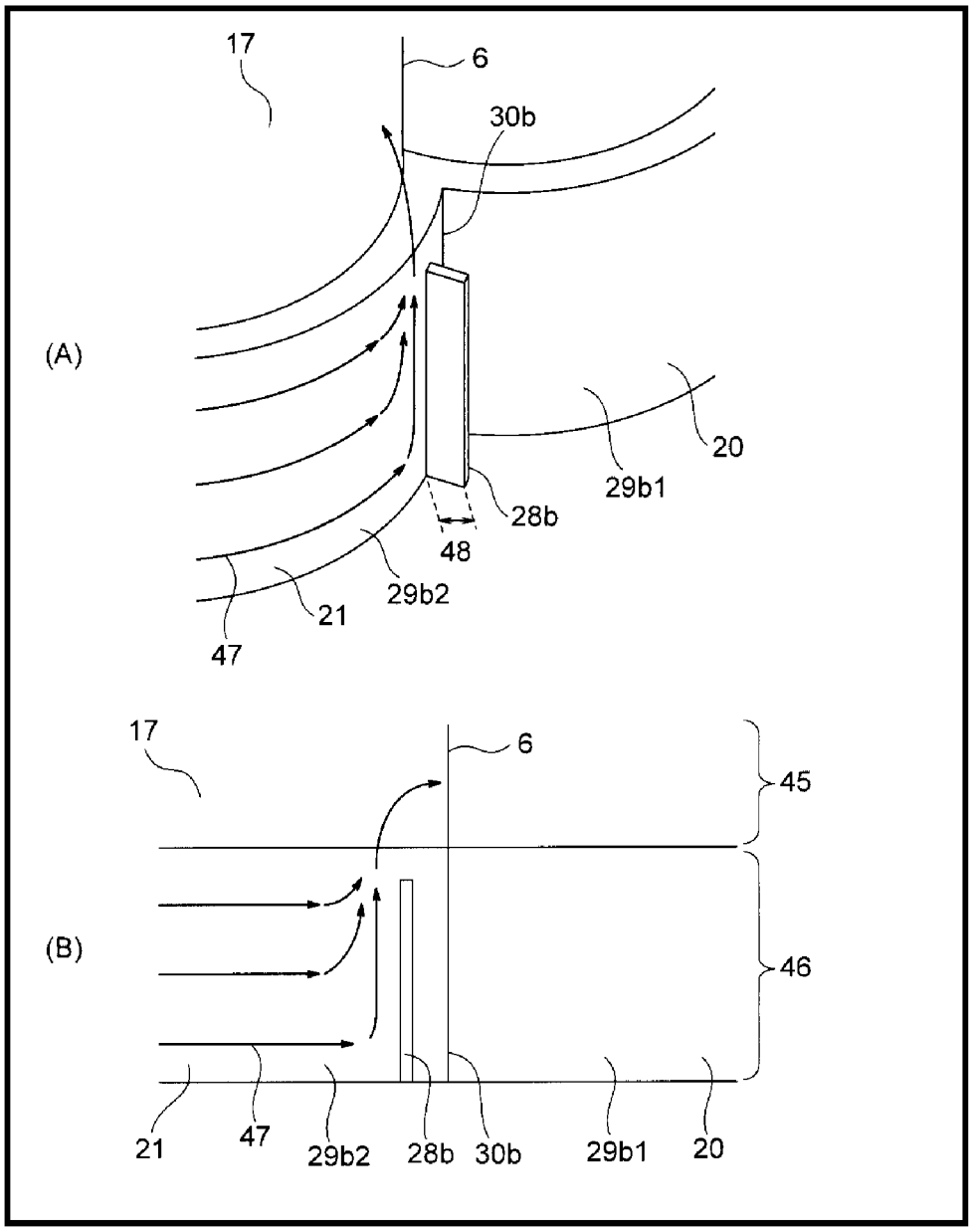
FIG. 13 is a diagram showing a flow of the cooling water near a position where a vertical wall 28*b* is set.

A flow of the cooling water on the rear surface side of the base section 21 in the groove-like cooling water channel 14*a*, in which the cylinder bore wall thermal insulator 20 is set, is explained in detail. FIG. 13 is a diagram showing a flow of the cooling water near a position where the vertical wall 28*b* is set. (A) is a perspective view and (B) is a view from the side on the rear surface side. In FIG. 13, cooling water 47 flowing on the rear surface side of the bore sections 29*b*2 of the base section hits the vertical wall 28*b* set before the boundary 30*b* in a flowing direction of the cooling water 47. The cooling water 47 hit the vertical wall 28*b* changes the flow upward and flows upward along the vertical wall 28*b*. The cooling water 47 flowing to the upper end of the vertical wall 28*b* flows in an upper part of the groove-like cooling water channel and flows to the boundary 6 between the bore walls of the cylinder bores in an upper part of the wall surface 17 on the cylinder bore side of the groove-like cooling water channel. In this way, in the portions of the bore sections **29*b*2 of the base section, the cooling water 47 flowing in a middle and lower part 46 of the groove-like cooling water channel changes the flow upward with the vertical wall 28*b*, flows upward along the vertical wall 28*b* and, when reaching the upper end of the vertical wall 28*b*, flows in the upper part 45 of the groove-like cooling water cannel, and flows toward the boundary 6 between the bore walls of the cylinder bores in the upper part of the wall surface 17** on the cylinder bore side of the groove-like cooling water channel.

The cooling water flowing on the rear surface side of the cylinder bore wall thermal insulator 20, in other words, in the middle and lower part of the groove-like cooling water channel has lower temperature compared with the cooling water flowing in the upper part of the groove-like cooling water channel. Therefore, with the cylinder bore wall thermal insulator 20, it is possible to cause, with the vertical wall 28, the cooling water on the rear surface side of the cylinder bore wall thermal insulator 20 having the low temperature to flow into the boundary 6 between the bore walls of the cylinder bores in the upper part where temperature is the highest in the wall surface on the cylinder bore side of the groove-like cooling water channel. Therefore, the cylinder bore wall thermal insulator 20 has high cooling efficiency of the wall surface on the cylinder bore side in the upper part of the groove-like cooling water channel.

Note that, as shown in FIG. 12, there is a gap between the vertical wall 28 and the wall surface 18 on the opposite side of the wall surface of the cylinder bore side of the groove-like cooling water channel. Therefore, in the groove-like cooling water channel **14*a* in one one-side half, not all of the cooling water flowing on the rear surface side of the cylinder bore wall thermal insulator 20, that is, the middle and lower part of the groove-like cooling water channel changes the flow with the vertical wall 28 and flows to the upper part of the groove-like cooling water channel. A small amount of the cooling water flowing in the middle and lower part of the groove-like cooling water channel continues to flow in the middle and lower part of the groove-like cooling water channel through the gap between the vertical wall 28 and the wall surface 18. In FIG. 12, the cylinder bore wall thermal insulator 40 is set in the middle and lower part of the groove-like cooling water channel 14*b* in the other one-side half. The cylinder bore wall thermal insulator 40 does not include a vertical wall on the rear surface side. Therefore, most of the cooling water flowing on the rear surface side of the cylinder bore wall thermal insulator 40, that is, in the middle and lower part of the groove-like cooling water channel 14*b* continues to flow in the middle and lower part of the groove-like cooling water channel 14*b***.

The cylinder bore wall thermal insulator 20 is manufactured by, for example, a method shown in FIG. 14 to FIG. 18. Note that the cylinder bore wall thermal insulator of the present invention is not limited to a thermal insulator manufactured by the method explained below.

Figure 14:
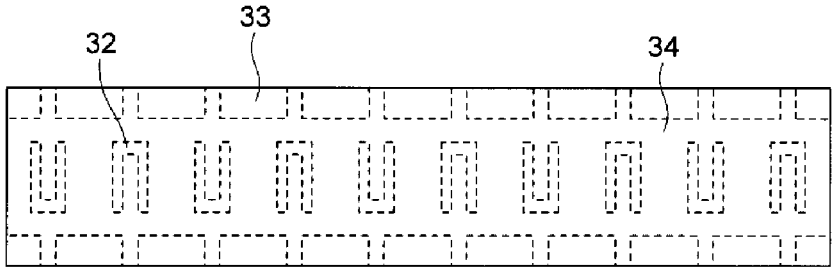
FIG. 14 is a schematic view showing a form example of a manufacturing method for the cylinder bore wall thermal insulator 20.
Figure 15:
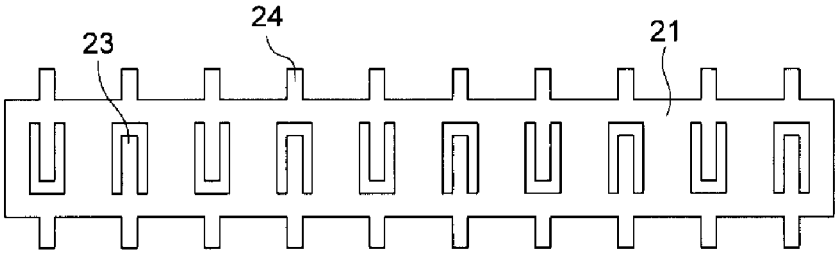
FIG. 15 is a schematic view showing a form example of the manufacturing method for the cylinder bore wall thermal insulator 20.

First, cut-off portions 32 and 33 indicated by dotted lines are cut off from a rectangular metal plate 34 shown in FIG. 14 to manufacture the base section 21 before molding shown in FIG. 15. In the base section 21, the bending section 24 are formed on the upper side and the lower side. The metal leaf springs 23 are formed in the center integrally with the base section 21.

Figure 16:
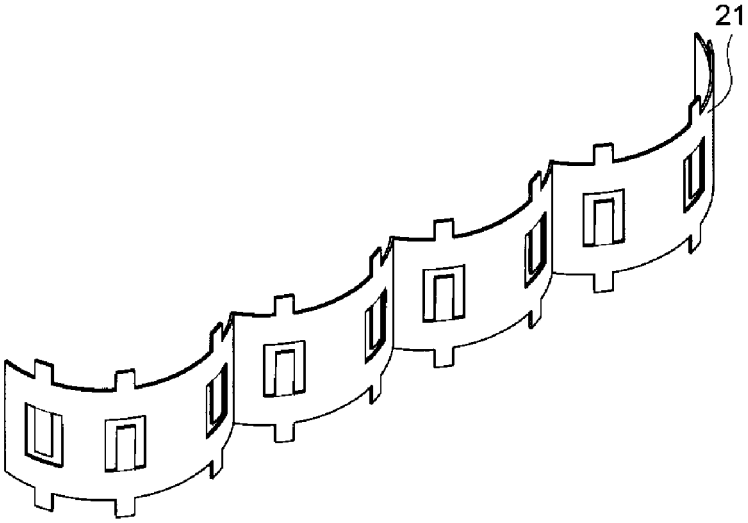
FIG. 16 is a schematic view showing a form example of the manufacturing method for the cylinder bore wall thermal insulator 20.

Subsequently, as shown in FIG. 16, the base section 21 before molding is molded into a shape conforming to the rear surface side of the rubber section 22 (the rear surface 33 side of the rubber section 22 shown in FIG. 14).

Figure 17:
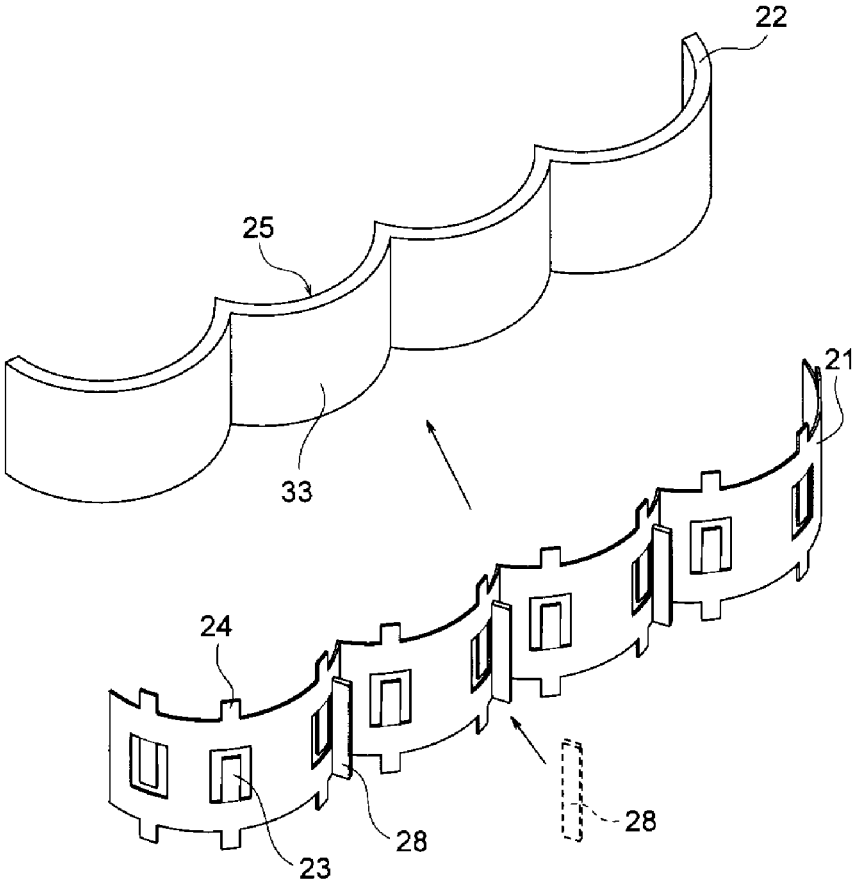
FIG. 17 is a schematic view showing a form example of the manufacturing method for the cylinder bore wall thermal insulator 20.

Subsequently, as shown in FIG. 17, the vertical walls 28 are caulked, fixed, and set in predetermined positions on the rear surface side of the base section 21. The rubber section 22, the contact surface 25 side of which is molded into a shape conforming to the wall surface 17 on the cylinder bore side of the groove-like cooling water channel 14, and the base section 21 after molding are joined.

Figure 18:
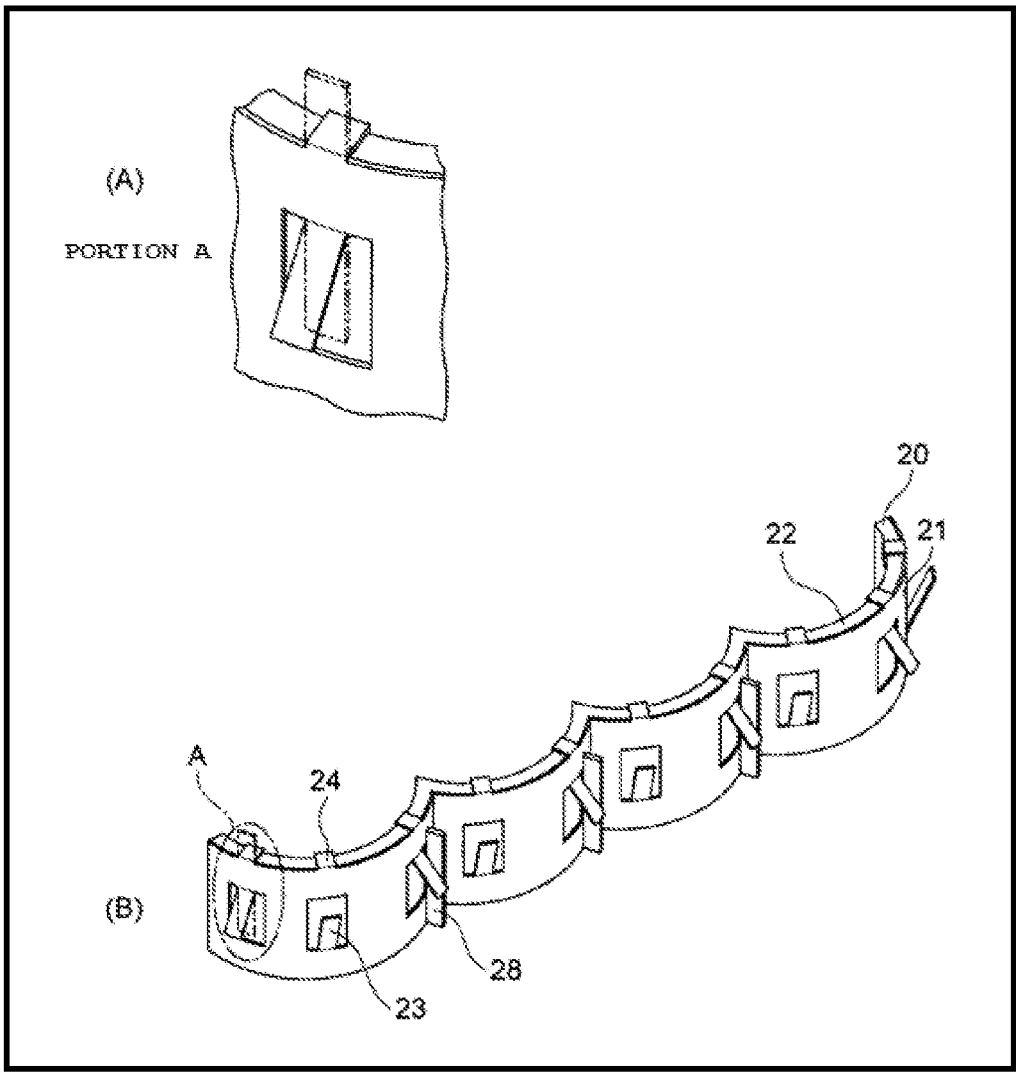
FIG. 18 is a schematic view showing a form example of the manufacturing method for the cylinder bore wall thermal insulator 20.

Subsequently, as shown in FIG. 18, the rubber section 22 is fixed to the base section 21 by bending the bending sections 24 to the rubber section side and sandwiching the rubber section 22 with the bending sections 24 and the base section 21. The metal leaf springs 23 are bent. Note that, in FIG. 18, a position before the bending of the bending section 24 and the metal spring 23 is indicated by a dotted line in a portion A surrounded by an alternate long and two short dashes line.

Another form example of the cylinder bore wall thermal insulator of the present invention is explained with reference to FIG. 19 to FIG. 22. A cylinder bore wall thermal insulator 56 shown in FIG. 19 to FIG. 22 includes four bore wall insulating sections 55 and a base section 54 to which the bore wall insulating sections 55 are fixed. In other words, in the cylinder bore wall thermal insulator 56, the bore wall insulating sections 55 are fixed one by one in four parts of the base section 54. In the cylinder bore wall thermal insulator 56, bending sections 57 formed in the bore wall insulating sections 55 are bent and the upper and lower end portions of the base section 54 are held by the bending sections 57, whereby the bore wall insulating sections 55 are fixed to the base section 54.

The cylinder bore wall thermal insulator 56 is, for example, a thermal insulator for insulating the wall surface **17*a* on the cylinder bore side of the groove-like cooling water channel in one one-side half of the cylinder block 11 shown in FIG. 10. On the wall surface 17*a* on the cylinder bore side of the groove-like cooling water channel in one one-side half of the cylinder block 11, there are four bore walls of cylinder bores. In the cylinder bore wall thermal insulator 56, the bore wall insulating sections 55 are provided for each of the bore walls of the cylinder bores. Therefore, four bore wall insulating sections 55 are provided in the cylinder bore wall thermal insulator 56**.

In the cylinder bore wall thermal insulator 56, a contact surface 46 of a rubber section 51 faces the wall surface side on the cylinder bore side of the groove-like cooling water channel. The bore wall insulating sections 55 are fixed such that the contact surface 46 of the rubber section 51 can come into contact with the wall surface 17 on the cylinder bore side of the groove-like cooling water channel 14. On the rear surface side of the cylinder bore wall thermal insulator 56, metal leaf springs 59 attached to the bore wall insulating sections 55 project toward the opposite side of the rubber section 51 through openings 62 of the base section 54. Projecting distal ends 63 of the metal leaf springs 59 come into contact with the wall surface 18 on the opposite side of the wall surface 17 on the cylinder bore side of the groove-like cooling water channel 14.

Figure 20:
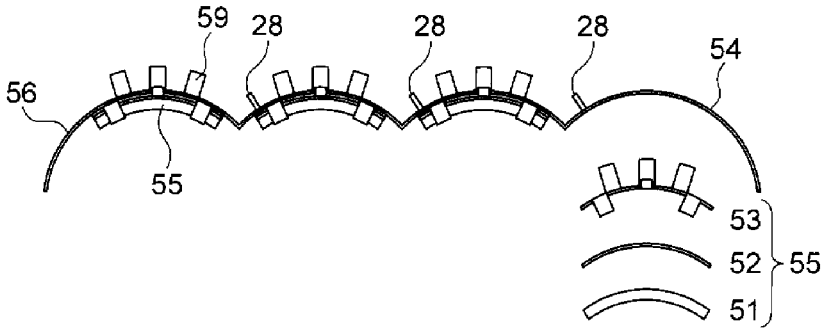
FIG. 20 is a plan view of the cylinder bore wall thermal insulator shown in FIG. 19 viewed from an upper side.
Figure 21:
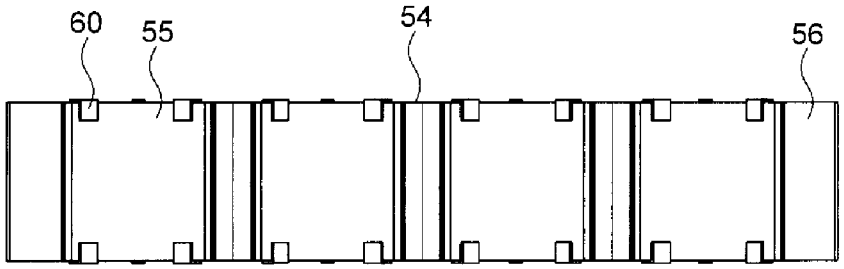
FIG. 21 is a view of the cylinder bore wall thermal insulator shown in FIG. 19 viewed from the rubber member side.
Figure 22:
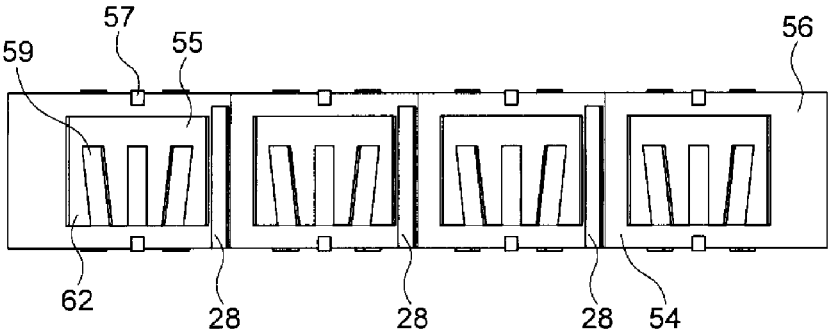
FIG. 22 is a view of the cylinder bore wall thermal insulator shown in FIG. 19 viewed from the rear surface side.

The bore wall insulating sections 55 fixed to the cylinder bore wall thermal insulator 56 include, as shown in FIG. 20, rubber sections 51, rear surface pressing members 52, and metal-leaf-spring attaching members 53. Note that, in FIG. 20, among the bore wall insulating sections 55 fixed to the thermal insulator 56, the bore wall insulating section at the right end is shown as being separated into each of the components.

The rubber section 51 is molded into an arcuate shape when viewed from above. A shape on the contact surface 46 side of the rubber section 51 is a shape conforming to the wall surface on the cylinder bore side of the groove-like cooling water channel 14. The rubber section 51 is a member directly in contact with the bore sections of the wall surface on the cylinder bore side of the groove-like cooling water channel to cover insulating parts of the bore sections of the wall surface on the cylinder bore side of the groove-like cooling water channel and insulate the bore sections of the wall surface on the cylinder bore side of the groove-like cooling water channel. The rear surface pressing member 52 is molded into an arcuate shape when viewed from above. The rear surface pressing member 52 has a shape conforming to the rear surface side (a surface on the opposite side of the contact surface 46 side) of the rubber section 51 such that the entire rubber section 51 can be pressed from the rear surface side of the rubber section 51. The metal-leaf-spring attaching member 53 is molded into an arcuate shape when viewed from above. The metal-leaf-spring attaching member 53 has a shape conforming to the rear surface side (a surface on the opposite side of the rubber member 51) of the rear surface pressing member 52. The metal leaf spring 59, which is an elastic member, is attached to the metal-leaf-spring attaching member 53. The metal leaf spring 59 is a vertically long rectangular metal plate. One end in the longitudinal direction of the metal leaf spring 59 is connected to the metal-leaf-spring attaching member 53. The metal leaf spring 59 is attached to the metal-leaf-spring attaching member 53 by being bent from the metal-leaf-spring attaching member 53 on the other end side 64 connected to the metal-leaf-spring attaching member 53 such that a distal end 63 separates from the metal-leaf-spring attaching member 53. The bending sections 60 formed on the upper side and the lower side of the metal-leaf-spring attaching member 53 are bent. The rubber section 51 and the rear surface pressing member 52 are fixed to the metal-leaf-spring attaching member 53 by being sandwiched between the metal-leaf-spring attaching member 53 and the bending sections 60. In the rubber section 51, the surface of the rubber section 51 on the opposite side of the rear surface pressing member 52 side is a contact surface 56 that is in contact with the wall surface 17 on the cylinder bore side of the groove-like cooling water channel.

The bore wall insulating sections 55 are members for insulating the bore walls of the cylinder bores. When the cylinder bore wall thermal insulator 56 is set in the groove-like cooling water channel 14 of the cylinder block 11, the rubber section 51 comes into contact with the wall surface 17 on the cylinder bore side of the groove-like cooling water channel 14 and covers the wall surface 17 on the cylinder bore side of the groove-like cooling water channel 14. The rear surface pressing member 52 presses, with an urging force of the metal leaf spring 59, which is the elastic member, the rubber 51 toward the wall surface 17 on the cylinder bore side of the groove-like cooling water channel 14 from the rear surface side and causes the rubber section 51 to adhere to the wall surface 17 on the cylinder bore side of the groove-like cooling water channel 14, whereby the bore wall insulating sections 55 insulates the bore walls of the cylinder bores.

The base section 54 is molded into a shape of continuous four arcs when viewed from above. The shape of the base section 54 is a shape conforming to a one-side half of the groove-like cooling water channel 14. In the base section 54, the openings 62 are formed such that the metal leaf springs 59 attached to the bore wall insulating sections 55 can pass through the base section 54 from the rear surface side of the cylinder bore wall thermal insulator 56 and project toward the wall surface 18 on the opposite side of the wall surface 17 on the cylinder bore side of the groove-like cooling water channel 14.

The base section 54 is a member to which the bore wall insulating sections 55 are fixed. The base section 54 plays a role of deciding positions of the bore wall insulating sections 55 such that the positions of the bore wall insulating sections 55 do not deviate in the groove-like cooling water channel 14. The base section 54 is formed by a continuous metal plate from one end side to the other end side when viewed from above.

The cylinder bore wall thermal insulator 56 includes the vertical wall 28 on the rear surface side. A position where the vertical wall 28 is provided is on the near side of the boundary 30 of each bore section of the base section 54 in the flowing direction of the cooling water when the cylinder bore wall thermal insulator 56 is set in the groove-like cooling water channel of the cylinder block. As a setting range in the up-down direction of the vertical wall 28, a lower end is up to the lower end of the base section 54 and an upper end is up to slightly below the upper end of the base section 54.

Figure 23:
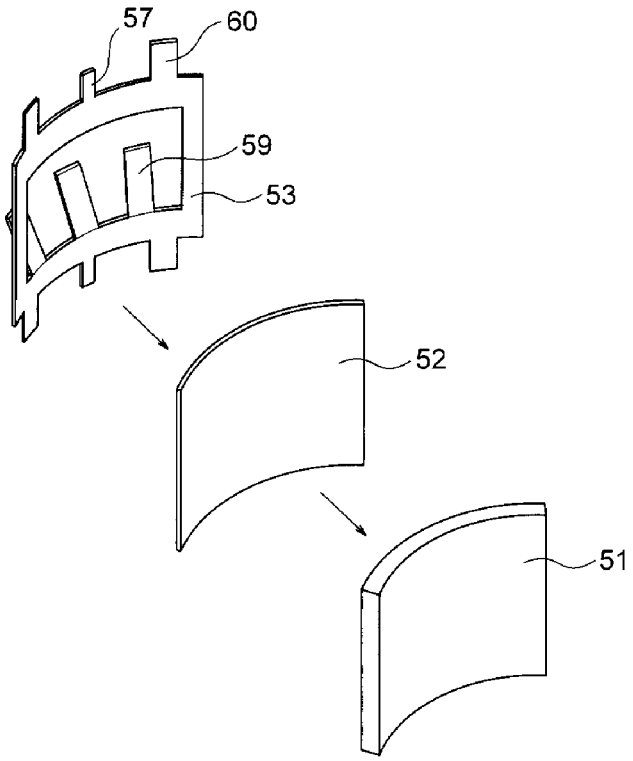
FIG. 23 is a view showing a state of manufacturing the insulating section 55 shown in FIG. 19.
Figure 24:
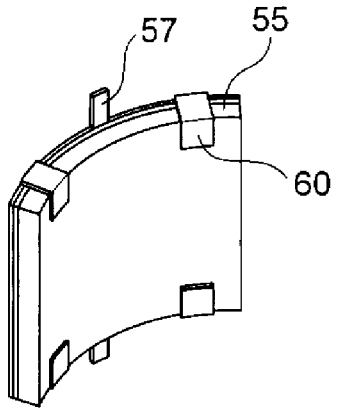
FIG. 24 is a perspective view showing the insulating section 55 before being fixed to a support section 54.
Figure 25:
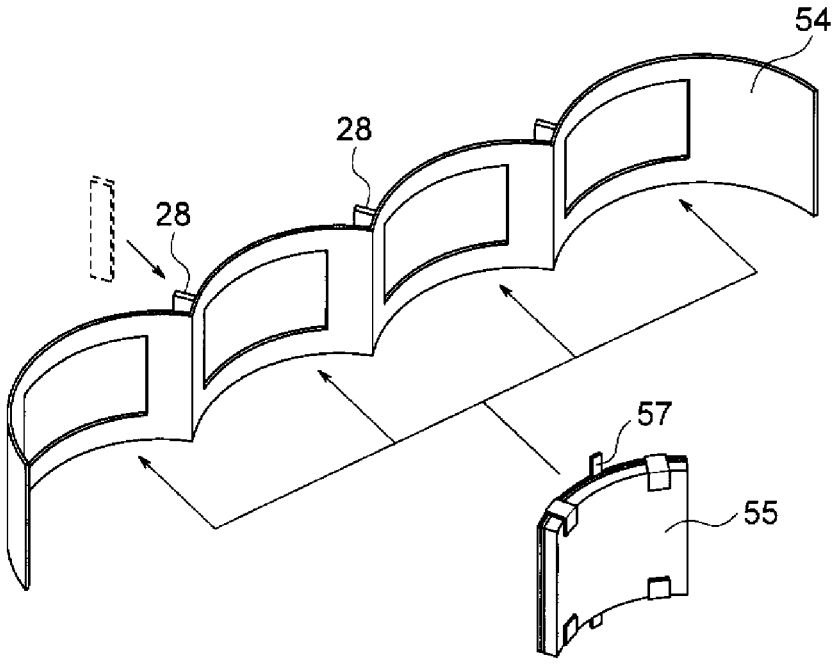
FIG. 25 is a view showing a state in which the insulating section 55 is fixed to the support section 54.

A manufacturing procedure of the cylinder bore wall thermal insulator 56 is explained. As shown in FIG. 23, the rear surface pressing member 52 and the metal-leaf-spring attaching member 53, in which the metal leaf springs 59 are attached and the bending sections 60 and the bending sections 57 are formed, are joined to the rubber section 51 from the rear surface side in order. Subsequently, the bending sections 60 are bent to hold the rear surface pressing member 52 and the rubber section 51 with the bending sections 60 as shown in FIG. 24, whereby the rear surface pressing member 52 and the rubber section 51 are fixed to the metal-leaf-spring attaching member 53 to manufacture the bore wall insulating section 55. As shown in FIG. 25, the vertical walls 28 are caulked and set on the rear surface of the support section 54. Four bore wall insulating sections 55 are manufactured. The bending sections 57 are bent in fixing parts of the base section 54 and the base section 54 is held by the bending sections 57, whereby the bore wall insulating sections 55 are fixed to the base section 54 to manufacture the cylinder bore wall thermal insulator 56.

A cylinder bore wall thermal insulator of the present invention is a cylinder bore wall thermal insulator set in a groove-like cooling water channel of a cylinder block of an internal combustion engine including cylinder bores to insulate a bore wall in a one-side half of bore walls of all the cylinder bores.

The thermal insulator includes one or more rubber sections in contact with a wall surface on the cylinder bore side of the groove-like cooling water channel to cover the wall surface on the cylinder bore side of the groove-like cooling water channel, a base section having a shape conforming to a shape of the one-side half of the groove-like cooling water channel, the one or more rubber sections or one or more members to which the one or more rubber sections are fixed being fixed to the base section, and one or more elastic members for urging the entire one or more rubber sections to be pressed from a rear surface side toward the wall surface on the cylinder bore side of the groove-like cooling water channel.

The thermal insulator includes a vertical wall on a near side of a boundary of each bore section of the base section in a flowing direction of cooling water.

The cylinder bore wall thermal insulator of the present invention is set in the groove-like cooling water channel of the cylinder block of the internal combustion engine. The cylinder block in which the cylinder bore wall thermal insulator of the present invention is set is a cylinder block of an open deck type in which two or more cylinder bores are formed side by side in series. When the cylinder block is the cylinder block of an open deck type in which two cylinder bores are formed side by side in series, the cylinder block includes cylinder bores including two end bores. When the cylinder block is a cylinder block of an open deck type in which three or more cylinder bores are formed side by side in series, the cylinder block includes cylinder bores including two end bores and one or more intermediate bores. Note that, in the present invention, among the cylinder bores formed in series, bores at both ends are referred to as end bores and a bore sandwiched by other cylinder bores on both sides is referred to as intermediate bore.

A position where the cylinder bore wall thermal insulator of the present invention is set is a groove-like cooling water channel. In many internal combustion engines, a position equivalent to a middle and lower part of the groove-like cooling water channel of the cylinder bore is a position where the speed of a piston increases. Therefore, it is desirable to insulate the middle and lower part of the groove-like cooling water channel. In FIG. 2, a position 10 near the middle between a top part 9 and a bottom part 8 of the groove-like cooling water channel 14 is indicated by a dotted line. A portion of the groove-like cooling water channel 14 in the lower side of the position 10 near the middle is referred to as middle and lower part of the groove-like cooling water channel. Note that the middle and lower part of the groove-like cooling water channel does not mean a portion below a position right in the middle between the top part and the bottom part of the groove-like cooling water channel and means a portion below the vicinity of the intermediate position between the top part and the bottom part. Depending on the structure of the internal combustion engine, the position where the speed of the piston increases is a position corresponding to a lower part of the groove-like cooling water channel of the cylinder bore. In that case, it is desirable to insulate the lower part of the groove-like cooling water channel. Therefore, it is appropriately selected to which position from the bottom part of the groove-like cooling water channel is insulated by the cylinder bore wall thermal insulator of the present invention, that is, in which position in the up-down direction of the groove-like cooling water channel the position of the upper end of the rubber member is set. Therefore, it is appropriately selected to which position from the bottom part of the groove-like cooling water channel is insulated by the thermal insulator of the present invention, that is, in which position in the up-down direction of the groove-like cooling water channel the position of the upper end of the rubber member is set.

The cylinder bore wall thermal insulator of the present invention is a thermal insulator for insulating a wall surface in a one-side half in the entire wall surface on the cylinder bore side of the groove-like cooling water channel. In other words, the cylinder bore wall thermal insulator of the present invention is a thermal insulator for insulating a bore wall in a one-side half of bore walls of all the cylinder bores.

The cylinder bore wall thermal insulator of the present invention includes one or more rubber sections, a base section, and one or more elastic members.

The rubber section is a member that is direct in contact with the wall surface on the cylinder bore side of the groove-like cooling water channel, covers the wall surface on the cylinder bore side of the groove-like cooling water channel, and insulates the cylinder bore wall. A member covering the rear surface side of the rubber section is pushed by an urging force of the elastic member. The rubber section is pressed against the wall surface on the cylinder bore side of the groove-like cooling water channel by the member. Therefore, the rubber section is molded into a shape conforming to the wall surface on the cylinder bore side of the groove-like cooling water channel when viewed from above. The shape of the rubber section viewed from a side is selected as appropriate according to a portion of the wall surface on the cylinder bore side of the groove-like cooling water channel covered by the rubber section.

Examples of the material of the rubber section include rubber such as solid rubber, expanding rubber, foamed rubber, and soft rubber and silicone-based gelatinous material. Heat-sensitive expanding rubber or water-swelling rubber that can expand a rubber member portion in the groove-like cooling water channel after setting of the cylinder bore wall thermal insulator is desirable in that the rubber member can strongly come into contact with the cylinder bore wall and prevent the rubber member from being shaved when the cylinder bore wall thermal insulator is set in the groove-like cooling water channel.

Examples of a composition of the solid rubber include natural rubber, butadiene rubber, ethylene propylene diene rubber (EPDM), nitrile butadiene rubber (NBR), silicone rubber, and fluorocarbon rubber.

Examples of the expanding rubber include heat-sensitive expanding rubber. The heat-sensitive expanding rubber is a composite body obtained by impregnating a thermoplastic substance having a lower melting point than a base form material in the base form material and compressing the thermoplastic substance. The heat-sensitive expanding rubber is a material, a compressed state of which is maintained by a hardened object of the thermoplastic substance present at least in a surface layer part thereof at the normal temperature and is released when the hardened object of the thermoplastic substance is softened by heating. Examples of the heat-sensitive expanding rubber include heat-sensitive expanding rubber described in Japanese Patent Laid-Open No. 2004-143262. When the material of the rubber member is the heat-sensitive expanding rubber, the cylinder bore wall thermal insulator of the present invention is set in the groove-like cooling water channel and heat is applied to the heat-sensitive expanding rubber, whereby the heat-sensitive expanding rubber expands to be deformed into a predetermined shape.

Examples of the base form material related to the heat-sensitive expanding rubber include various polymeric materials such as rubber, elastomer, thermoplastic resin, and thermosetting resin. Specifically, examples of the base form material include natural rubber, various synthetic rubbers such as chloropropylene rubber, styrene butadiene rubber, nitrile butadiene rubber, ethylene propylene diene terpolymer, silicone rubber, fluorocarbon rubber, and acrylic rubber, various elastomers such as soft urethane, and various thermosetting resins such as hard urethane, phenolic resin, and melamine resin.

As the thermoplastic substance related to the heat-sensitive expanding rubber, a thermoplastic substance, any one of a glass transition point, a melting point, and a softening temperature of which is lower than 120° C., is desirable. Examples of the thermoplastic substance related to the heat-sensitive expanding rubber include thermoplastic resin such as polyethylene, polypropylene, polystyrene, polyvinyl chloride, polyvinylidene chloride, polyvinyl acetate, polyacrylic ester, styrene butadiene copolymer, chlorinated polyethylene, polyvinylidene fluoride, ethylene-vinyl acetate copolymer, ethylene vinyl chloride acrylate copolymer, ethylene-vinyl acetate copolymer, ethylene-vinyl acetate copolymer, nylon, acrylonitrile-butadiene copolymer, polyacrylonitrile, polyvinyl chloride, polychloroprene, polybutadiene, thermoplastic polyimide, polyacetal, polyphenylene sulfide, polycarbonate, and thermoplastic polyurethane and various thermoplastic compounds such as low-melting point glass flit, starch, solder, and wax.

Examples of the expanding rubber include water-swelling rubber. The water swelling rubber is a material obtained by adding a water-absorbing substance to rubber and is a rubber material that absorbs water and swells and has firmness for retaining an expanded shape. Examples of the water-swelling rubber include rubber materials obtained by adding water-absorbing materials such as a crosslinking substance of a polyacrylic acid neutralized product, starch acrylic acid graft copolymer cross linking substance, cross-linked carboxymethyl cellulose salt, and polyvinyl alcohol to rubber. Examples of the water-swelling rubber include water-swelling rubber containing ketimine polyamide resin, glycidyl ethers, water-absorbing resin, and rubber described in Japanese Patent Laid-Open No. 9-208752. When the material of the rubber member is the water-swelling rubber, the cylinder bore wall thermal insulator of the present invention is set in the groove-like cooling water channel and the cooling water is fed and the water-swelling rubber absorbs the water, whereby the water-swelling rubber expands to be deformed into a predetermined shape.

The foamed rubber is porous rubber. Examples of the foamed rubber include sponge-like foamed rubber having an open-cell structure, foamed rubber having a closed-cell structure, and a semi-independent foamed rubber. Examples of the material of the foamed rubber include ethylene propylene diene terpolymer, silicone rubber, nitrile butadiene copolymer, silicone rubber, and fluorocarbon rubber. An expansion ratio of the foamed rubber is not particularly limited and is selected as appropriate. It is possible adjust a water content of the rubber member by adjusting the expansion ratio. Note that the expansion ratio of the foamed rubber indicates a density ratio before and after foaming represented by ((pre-foaming density−post-foaming density)/pre-foaming density)×100.

When the material of the rubber section is a material that can contain water such as the water-swelling rubber or the foamed rubber, when the cylinder bore wall thermal insulator of the present invention is set in the groove-like cooling water channel and the cooling water is fed to the groove-like cooling water channel, the rubber section contains water. In which range the water content of the rubber section is set when the cooling water is fed to the groove-like cooling water channel is selected as appropriate according to operation conditions and the like of the internal combustion engine. Note that the water content indicates a weight water content represented by (cooling water weight/(filler weight+cooling water weight))×100.

Figure 19:
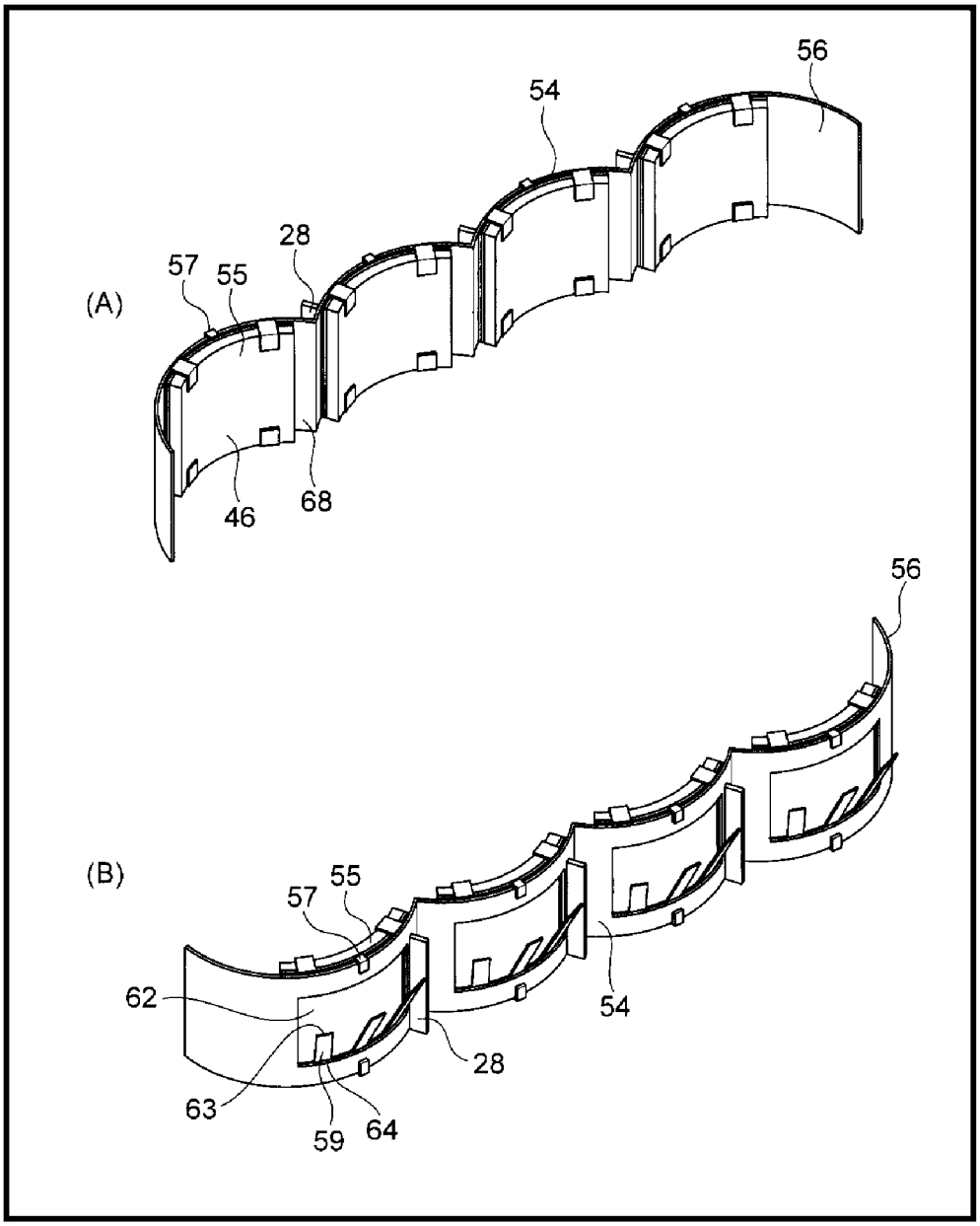
FIG. 19 is a schematic perspective view showing a form example of the cylinder bore wall thermal insulator of the present invention.

Note that the rubber section may have a shape covering a plurality of bore sections of the wall surface on the cylinder bore side of the groove-like cooling water channel as in the form example shown in FIG. 4 or may have a shape covering each of the bore sections of the wall surface on the cylinder bore side of the groove-like cooling water channel as in the form example shown in FIG. 19.

The thickness of the rubber member is not particularly limited and is selected as appropriate.

The base section is a member to which the rubber section or a member to which the rubber section is fixed is fixed. In other words, the base section is a member to which the rubber section is directly fixed or indirectly fixed via another member. Examples of a form example in which the rubber section is directly fixed to the base section include a form example in which, as in the form example shown in FIG. 4, a part for fixing the rubber section to the base section (in the form example shown in FIG. 4, the bending section) is provided and the rubber section is directly fixed to the base section by the part. Examples of a form example in which the rubber section is indirectly fixed to the base section via another member include a form example in which, as in the form example shown in FIG. 19, the rubber section is fixed to a metal-spring attaching member and a thermal insulator manufactured by fixing the rubber section to the metal-leaf-spring attaching member is fixed to the base section, whereby the rubber section is indirectly fixed to the base section via another member.

The base section is a member for deciding a position of the rubber section such that the position of the rubber section in the groove-like cooling water channel does not deviate. Therefore, the base section has a shape conforming to the groove-like cooling water channel and continues from one end side to the other end side. The base section is molded into a shape of continuous arcs when viewed from above. Examples of the material of the base section include a metal plate of stainless steel (SUS), an aluminum alloy, or the like and synthetic resin. Note that, when the base section is made of the metal plate, the base section may be manufactured by molding one metal plate or may be manufactured by connecting a plurality of metal plates if the base section continues from one end side to the other end side. When the base section is made of the synthetic resin, the base section is usually an integrally molded body.

The elastic member is a member that is elastically deformed when the cylinder bore wall thermal insulator of the present invention is set in the groove-like cooling water channel and urges the rubber section with an elastic force to be pressed toward the wall surface on the cylinder bore side of the groove-like cooling water channel.

A form of the elastic member is not particularly limited. Examples of the form of the elastic member include a tabular elastic member, a coil-like elastic member, a leaf spring, a torsion spring, and elastic rubber. The material of the elastic member is not particularly limited. However, stainless steel (SUS), an aluminum alloy, or the like is desirable because LLC resistance is high and strength is high. As the elastic member, a metal elastic member such as a metal leaf spring, a coil spring, a leaf spring, or a torsion spring is desirable. When the elastic member is the metal leaf spring, it is desirable that a portion in contact with the wall surface on the opposite side of the wall surface on the cylinder bore side of the groove-like cooling water channel and the vicinity of the portion are molded into a curved surface shape swelling to the wall surface on the opposite side of the wall surface on the cylinder bore side of the groove-like cooling water channel because it is possible to prevent the wall surface on the opposite side of the wall surface on the cylinder bore side of the groove-like cooling water channel from being damaged by a contact portion with the wall surface of the elastic member when the cylinder bore wall thermal insulator of the present invention is inserted in to the groove-like cooling water channel. In other words, in the metal leaf spring, which is the elastic member, a distal end portion in contact with the wall surface on the opposite side of the wall surface on the cylinder bore side of the groove-like cooling water channel is formed in a curved surface shape swelling to the wall surface on the opposite side of the wall surface on the cylinder bore side of the groove-like cooling water channel.

In the cylinder bore wall thermal insulator of the present invention, a form, a shape, a size, a setting position, a setting number, and the like of the elastic members are selected as appropriate according to the shape and the like of the groove-like cooling water channel such that the rubber section is urged by an appropriate pressing force by the elastic members when the thermal insulator is set in the groove-like cooling water channel.

In the cylinder bore wall thermal insulator 20 shown in FIG. 4, the base section and the metal leaf spring, which is the elastic member, are integrally molded and the rubber member is fixed to the base section in which the metal leaf spring is formed, whereby the elastic member is attached to the thermal insulator. In the cylinder bore wall thermal insulator 56 shown in FIG. 19, the metal-leaf-spring attaching member and the metal leaf spring, which is the elastic member, are integrally molded, the thermal insulator is manufactured by fixing the rubber member and the rear surface pressing member to the metal-leaf-spring attaching member in which the metal leaf spring is formed, and the thermal insulator is fixed to the base section, whereby the elastic member is attached to the thermal insulator. However, a method of attaching the elastic member to the thermal insulator is not particularly limited. Examples of other methods include a method of welding a metal elastic member such as a metal leaf spring, a metal coil spring, a leaf spring, or a torsion spring to the base section or the rear surface pressing member made of a metal plate to thereby attach the elastic member to the rear surface side of the thermal insulator and fixing the rubber member to the base section, the rear surface pressing member, or the like to which the elastic member is welded The cylinder bore wall thermal insulator of the present invention includes the vertical wall on the rear surface side of the base section. The vertical wall plays a role of directing the cooling water flowing on the rear surface side of the cylinder bore wall thermal insulator of the present invention (in other words, the cooling water flowing in the middle and lower part of the groove-like cooling water channel) toward the upper part of the groove-like cooling water channel before the boundary of each bore section of the base section (in other words, before the boundary of each bore section of the wall surface on the cylinder bore side of the groove-like cooling water channel) and feeding the cooling water flowing on the rear surface side of the cylinder bore wall thermal insulator of the present invention to the upper part of the boundary of each bore section of the wall surface on the cylinder bore side of the groove-like cooling water channel or the vicinity of the upper part.

Figure 26:
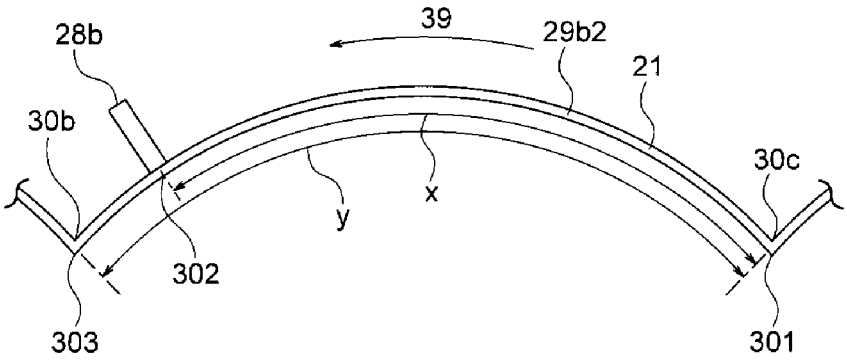
FIG. 26 is an enlarged view of one bore section of a base section.

In the cylinder bore wall thermal insulator of the present invention, a setting position of the vertical wall when viewed from the above is the rear surface side of the base section and, in the flowing direction of the cooling water, the near side of the boundary of each bore section of the base section. The setting position of the vertical wall is explained with reference to FIG. 26. FIG. 26 is an enlarged view of each bore section for one bore section in the base section and is a view of each bore section of the base section viewed from above. In FIG. 26, as indicated by an arrow of reference numeral 39, the cooling water flows in a direction from the boundary 30*c* to the boundary 30*b* on the rear surface side of each bore section 29*b*2 of the base section. A range of each bore section 29*b*2 of the base section is from the boundary 30*c* to the boundary 30*b*. In other words, the range is from one end 301 to the other end 303 of each section 29*b*2 of the base section when each bore section 29*b*2 of the base section is viewed from above. Then, when focusing on one bore section of each bore section 29*b*2 of the base section, on the rear surface side of each bore section 29*b*2 of the base section, the cooling water flows toward the boundary 30*b* stating from the boundary 30*c* of each bore section 29*b*2 of the base section. The vertical wall 28*b* is set on the near side of the boundary 30*b* in the direction from one end of each bore section of the base section, that is, the boundary 30*c* of each bore section 29*b*2 of the base section, which is a start point of the cooling water flow, to the other end of each bore section of the base section, that is, the boundary 30*b* of each bore section 29*b*2 of the base section.

In the cylinder bore wall thermal insulator of the present invention, the setting position of the vertical wall when viewed from above only has to be before the boundary of each bore section of the base section in the flowing direction of the cooling water and have a distance from the boundary of each bore section of the base section in a degree for achieving the effect of the present invention. The setting position is selected as appropriate. Note that, in the present invention, as shown in FIG. 26, a range in which a ratio (x/y) of length x of each bore section 29*b*2 of the base section from one end 301 (a start point of the flow of the cooling water on the rear surface side of each bore section 29*b*2 of the base section) of each bore section of the base section to a setting position 302 of the vertical wall 28*b* to length y of each bore section 29*b*2 of the base section from one end 301 of each bore section of the base section to the other end 303 of each bore section of the base section is 0.5 or more is set as the near side of the boundary 30*b* in the flowing direction of the cooling water. In the present invention, as shown in FIG. 26, the setting position of the vertical wall is desirably a position where the ratio (x/y) of the length x of each bore section 29*b*2 of the base section from one end 301 of each bore section of the base section to the setting position 302 of the vertical wall 28*b* to the length y of each bore section 29*b*2 of the base section from one end 301 of each bore section of the base section to the other end 303 of each bore section of the base section is 0.5 to 0.9 and more desirably a position where the ratio is 0.75 to 0.9.

In the cylinder bore wall thermal insulator of the present invention, the setting range of the vertical wall in the up-down direction is selected as appropriate according to the setting of a cooling range in the upper part of the cylinder bore wall by the cooling water. In other words, the cooling range in the upper part of the cylinder bore wall by the cooling water is set. The vertical wall is set in a range further on the lower side than the cooling range. Therefore, the position of the upper end of the vertical wall is above the upper end of the base section in some cases and is the same position as the upper end of the base section or below the upper end of the base section in other cases. The position of the upper end of the vertical wall is selected as appropriate according to the setting of the cooling range in the upper part of the cylinder bore wall by the cooling water. The position of the lower end of the vertical wall is selected as appropriate in a range in which most of the cooling water flowing on the rear surface side of the cylinder bore wall thermal insulator of the present invention hits the vertical wall and changes the flow upward and the effect of the present invention is achieved. In other words, the position of the lower end of the vertical wall may be the same position as the lower end of the base section or may be above the lower end of the base section.

When there is no gap or a gap is very small between the vertical wall and the wall surface on the opposite side of the wall surface on the cylinder bore side of the groove-like cooling water channel, a pressure loss in the groove-like cooling water channel is excessively large. Therefore, in the cylinder bore wall thermal insulator of the present invention, the width (in FIG. 13(A), length of a reference numeral 48) of the vertical wall is selected as appropriate in a range in which the flow of the cooling water flowing on the rear surface side of the cylinder bore wall thermal insulator of the present invention is not completely blocked and the pressure loss in the groove-like cooling water channel is not excessively large.

In the cylinder bore wall thermal insulator of the present invention, a setting number of the vertical walls is selected as appropriate. For example, as in the form example shown in FIG. 4 or the form example shown in FIG. 19, the vertical walls may be provided one by one for each boundary of each bore section of the support section. One vertical wall may be set in a place where a setting effect of the vertical wall most frequently appears. A setting method of the vertical wall in the base section is not particularly limited. For example, when the base section is made of metal, there is a method of caulking and setting the vertical wall in the base section and a method of welding and setting the vertical wall in the base section.

In the cylinder bore wall thermal insulator of the present invention, the base section and the vertical wall are desirably formed of a metal plate because it is easy to fix the vertical wall to the base section.

In the form example shown in FIG. 4 or the form example shown in FIG. 19, the vertical wall is set perpendicularly to the flowing direction of the cooling water. However, in the cylinder bore wall thermal insulator of the present invention, a setting angle of the vertical wall may be slightly tilted from the direction perpendicular to the flowing direction. In the cylinder bore wall thermal insulator of the present invention, the vertical wall is desirably set perpendicularly to the flowing direction of the cooling water because the setting of the vertical wall is easy.

The cylinder bore wall thermal insulator of the present invention can include a cooling-water-flow partitioning member on one end side. In FIG. 12, the cooling-water-flow partitioning member 38 is attached to the cylinder bore wall thermal insulator 40, which is the cylinder bore wall thermal insulator not corresponding to the cylinder bore wall thermal insulator of the present invention, whereby the cooling water in the groove-like cooling water channel is controlled to flow in the direction of the arrow 39 in FIG. 12. In other words, the cooling water is controlled not to immediately flow into the cooling water discharge port 16 from the cooling water supply port 15. However, for example, when there is no member for controlling the flowing direction of the cooling water such as the cooling-water-flow partitioning member 38 other than the cylinder bore wall thermal insulator of the present invention, a member for controlling the flowing direction of the cooling water can be attached to the cylinder bore wall thermal insulator of the present invention. The cylinder bore wall thermal insulator of the present invention can include another member or the like for adjusting the flow of the cooling water. The cylinder bore wall thermal insulator of the present invention can include, in the base section, a member for preventing the entire thermal insulator from deviating in the upward direction, for example, a cylinder head contact member that is attached to the upper side of the base section, the upper end of the cylinder head contact member being in contact with a cylinder head or a cylinder head gasket.

As in the form example shown in FIG. 12, the cylinder bore wall thermal insulator of the present invention is desirably set in the groove-like cooling water channel in the one-side half in the latter half of the direction of the cooling water flow in the entire groove-like cooling water channel. The cooling water flowing in the groove-like cooling water channel of the cylinder block is controlled to flow in the groove-like cooling water channel in one one-side half in the entire groove-like cooling water channel first and thereafter flow in the groove-like cooling water channel in the other one-side half. When a flow rate of the cooling water is controlled such that, as the cooling water flows in the groove-like cooling water channel, the cooling water is extracted to the cylinder head side little by little (e.g., the cooling water is extracted from an extraction path of the cooling water called drill path provided in the cylinder head near the boundary of each bore of the cylinder bores), the flow rate of the cooling water is small in the groove-like cooling water channel in the one-side half in the latter half (the other one-side half) compared with the groove-like cooling water channel in the one-side half in the former half (one one-side half). Therefore, in such a case, by setting the cylinder bore wall thermal insulator of the present invention in the groove-like cooling water channel in the one-side half in the latter half, in the groove-like cooling water channel in the one-side half in the latter half (the other one-side half) in which the flow rate of the cooling water flowing in the groove-like cooling channel decreases, the cooling water flowing in the middle and lower part of the groove-like cooling water channel in which heat is not received from the bore wall and temperature is low can be fed to the upper part of the groove-like cooling water channel. Therefore, cooling efficiency of the wall surface on the cylinder bore side in the upper part of the groove-like cooling water channel increases.

An internal combustion engine according to a first aspect of the present invention is an internal combustion engine, in a cylinder block of which a groove-like cooling water channel is formed.

The cylinder bore wall thermal insulator of the present invention is set in a groove-like cooling water channel in a one-side half in the groove-like cooling water channel.

An internal combustion engine according to a second aspect of the present invention is an internal combustion engine, a cylinder block of which a groove-like cooling water channel is formed.

The groove-like cooling water channel is partitioned such that the cooling water flowing in the groove-like cooling water channel flows to a groove-like cooling water channel in one one-side half first and, thereafter, flows in a groove-like cooling water channel in another one-side half.

The cylinder bore wall thermal insulator of the present invention is set in the groove-like cooling water channel in the other one-side half (the one-side half in the latter half). The internal combustion engine according to the second aspect of the present invention may include the cylinder bore wall thermal insulator in the groove-like cooling water channel in the one one-side half (the one-side half in the former half) or may not include the cylinder bore wall thermal insulator.

An automobile of the present invention is an automobile including the internal combustion engine according to the first aspect or the second aspect of the present invention.

INDUSTRIAL APPLICABILITY

According to the present invention, it is possible to reduce a difference in a deformation amount between the upper side and the lower side of the cylinder bore wall of the internal combustion engine. Therefore, since the friction of the piston can be reduced, it is possible to provide a fuel-saving internal combustion engine.

REFERENCE SIGNS LIST

6 boundary of each bore section of the wall surface 17 on the cylinder bore side of the groove-like cooling water channel 14
7 inter-bore wall
8 bottom part
9 top part
position near the middle
11 cylinder block
12 bore
12*a*1, 12*a*2 end bore
12*b*1, 12*b*2 intermediate bore
13 cylinder bore wall
14 groove-like cooling water channel
14*a*, 14*b* groove-like cooling water channel in a one-side half
15 cooling water supply port
16 cooling water discharge port
17 wall surface on the cylinder bore side of the groove-like cooling water channel
17*a*, 17*b* wall surface on the cylinder bore side of the groove-like cooling water channel in the one-side half
18 wall surface on the opposite side of the wall surface 17 on the cylinder bore side of the groove-like cooling water channel
20 cylinder bore wall thermal insulator
21 base section
22 rubber section
23 metal leaf spring member
24 bending section
25 contact surface
26 one end
27 the other end
28, 28*b* vertical wall
29, 29*a*1, 29*a*2, 29*b*1, 29*b*2 each bore section of the base section
30, 30*a*, 30*b*, 30*c* boundary of each bore section of the base section
32, 32 cut-off portion
34 metal plate
35*a*1, 35*a*2, 35*b*1, 35*b*2 each bore section of the rubber section
38 cooling-water-flow partitioning member
39 flowing direction of cooling water
40 cylinder bore wall thermal insulator
41 base section
42 rubber section
43 metal leaf spring member
45 upper part of the groove-like cooling water channel
46 middle and lower part of the groove-like cooling water channel
47 cooling water
48 width of a vertical wall
51 rubber member
52 rear surface side pressing member
53 metal-leaf-spring attaching member
54 base section
55 thermal insulator
56 cylinder bore wall thermal insulator
57, 60 bending section
59 metal leaf spring member
62 opening
301 one end of each bore section of the base section
302 setting position of the vertical wall
303 the other end of each bore section of the base section

The invention claimed is:

1. A cylinder bore wall thermal insulator configured to be set in a groove-like cooling water channel in a cylinder block of an internal combustion engine including cylinder bores, the cylinder bore wall thermal insulator comprising:

one or more rubber sections configured to be in contact with a wall surface on a cylinder bore side of the groove-like cooling water channel to cover the wall surface on the cylinder bore side of the groove-like cooling water channel;

a base section having a shape conforming to a shape of one half of the groove-like cooling water channel, the shape of the one half of the groove-like cooling water channel being obtained by dividing the groove-like cooling water channel along a line extending through the cylinder bores; and one or more elastic members configured to urge the one or more rubber sections toward the wall surface on the cylinder bore side of the groove-like cooling water channel from a rear surface side of the one or more rubber sections, wherein the one or more rubber sections, or one or more members to which the one or more rubber sections are fixed, are fixed to the base section, wherein the base section comprises bore sections corresponding to the cylinder bores of the internal combustion engine, wherein the base section comprises a boundary between one of the bore sections and an adjacent one of the bore sections, in a flowing direction of cooling water, wherein the base section includes a vertical wall protruding from a curved portion of the base section, the vertical wall being set between (i) one of the one or more elastic members which is nearest to the boundary in a direction opposite to the flowing direction of cooling water, and (ii) the boundary, and wherein the cylinder bore wall thermal insulator insulates a bore wall between the cylinder bores and the groove-like cooling water channel.

2. The cylinder bore wall thermal insulator according to claim 1, wherein the base section and the vertical wall are made of a metal plate.

3. The cylinder bore wall thermal insulator according to claim 1, wherein the one or more rubber sections are heat-sensitive expanding rubber or water-swelling rubber.

4. An internal combustion engine, comprising:

a cylinder block in which a groove-like cooling water channel is formed, one half of the groove-like cooling water channel corresponding to a shape obtained by dividing the groove-like cooling water channel along a line extending through cylinder bores of the internal combustion engine;

wherein the cylinder bore wall thermal insulator according to claim 1 is set in the one half of the groove-like cooling water channel.

5. An internal combustion engine, comprising:

a cylinder block in which a groove-like cooling water channel is formed, a first half and a second half of the groove-like cooling water channel corresponding to a shape obtained by dividing the groove-like cooling water channel along a line extending through cylinder bores of the internal combustion engine; and the cylinder bore wall thermal insulator according to claim 1, wherein the groove-like cooling water channel is partitioned such that the cooling water flowing in the groove-like cooling water channel flows to the first half of the groove-like cooling water channel and, thereafter, flows to the second half of the groove-like cooling water channel, and wherein the cylinder bore wall thermal insulator according to claim 1 is set in the second half of the groove-like cooling water channel.

6. An automobile comprising the internal combustion engine according to claim 4.

7. The cylinder bore wall thermal insulator according to claim 2, wherein the one or more rubber sections are heat-sensitive expanding rubber or water-swelling rubber.

8. An internal combustion engine, comprising:

a cylinder block in which a groove-like cooling water channel is formed, one half of the groove-like cooling water channel corresponding to a shape obtained by dividing the groove-like cooling water channel along a line extending through cylinder bores of the internal combustion engine;

wherein the cylinder bore wall thermal insulator according to claim 2 is set in the one half of the groove-like cooling water channel.

9. An internal combustion engine, comprising:

a cylinder block in which a groove-like cooling water channel is formed, one half of the groove-like cooling water channel corresponding to a shape obtained by dividing the groove-like cooling water channel along a line extending through cylinder bores of the internal combustion engine;

wherein the cylinder bore wall thermal insulator according to claim 3 is set in the one half of the groove-like cooling water channel.

10. An internal combustion engine, comprising:

a cylinder block in which a groove-like cooling water channel is formed, a first half and a second half of the groove-like cooling water channel corresponding to a shape obtained by dividing the groove-like cooling water channel along a line extending through cylinder bores of the internal combustion engine; and the cylinder bore wall thermal insulator according to claim 2, wherein the groove-like cooling water channel is partitioned such that the cooling water flowing in the groove-like cooling water channel flows to the first half of the groove-like cooling water channel and, thereafter, flows to the second half of the groove-like cooling water channel, and wherein the cylinder bore wall thermal insulator according to claim 2 is set in the second half of the groove-like cooling water channel.

11. An internal combustion engine, comprising:

a cylinder block in which a groove-like cooling water channel is formed, a first half and a second half of the groove-like cooling water channel corresponding to a shape obtained by dividing the groove-like cooling water channel along a line extending through cylinder bores of the internal combustion engine; and the cylinder bore wall thermal insulator according to claim 3, wherein the groove-like cooling water channel is partitioned such that the cooling water flowing in the groove-like cooling water channel flows to the first half of the groove-like cooling water channel and, thereafter, flows to the second half of the groove-like cooling water channel, and wherein the cylinder bore wall thermal insulator according to claim 3 is set in the second half of the groove-like cooling water channel.

12. An automobile comprising the internal combustion engine according to claim 5.

* * * * *